US011168676B2

(12) United States Patent
Lesko

(10) Patent No.: US 11,168,676 B2
(45) Date of Patent: Nov. 9, 2021

(54) MUD PUMP

(71) Applicant: Gerald Lesko, Edmonton (CA)

(72) Inventor: Gerald Lesko, Edmonton (CA)

( * ) Notice: Subject to any disclaimer, the term of this patent is extended or adjusted under 35 U.S.C. 154(b) by 307 days.

(21) Appl. No.: 16/448,258

(22) Filed: Jun. 21, 2019

(65) Prior Publication Data

US 2020/0362678 A1 Nov. 19, 2020

(30) Foreign Application Priority Data

May 17, 2019 (CA) ..... CA 3043739

(51) Int. Cl.

| | |
|---|---|
| ***F04B 19/04*** | (2006.01) |
| ***F04B 19/22*** | (2006.01) |
| ***F04B 9/04*** | (2006.01) |
| ***F04B 15/02*** | (2006.01) |

(52) U.S. Cl.

CPC ..... *F04B 19/04* (2013.01); *F04B 9/045* (2013.01); *F04B 15/02* (2013.01); *F04B 19/22* (2013.01)

(58) Field of Classification Search

CPC ..... F04B 1/02; F04B 1/0413; F04B 1/0439; F04B 1/0408; F04B 1/0426; F04B 53/001; F04B 53/003; F04B 53/006; F04B 53/144; F04B 53/145; F04B 9/045; F04B 15/02; F04B 17/03; F04B 17/06; F04B 19/04; F04B 19/22; E21B 21/001; E21B 21/01; E21B 43/128

See application file for complete search history.

(56) References Cited

U.S. PATENT DOCUMENTS

| | | | | |
|---|---|---|---|---|
| 3,896,926 | A | 7/1975 | Cuniberti | |
| 4,512,291 | A | 4/1985 | Kirk | |
| 6,164,188 | A | 12/2000 | Miser | |
| 7,364,412 | B2 | 4/2008 | Kugelev et al. | |
| 9,011,111 | B2 * | 4/2015 | Lesko | F04B 53/146 417/410.1 |
| 2004/0244576 | A1 | 12/2004 | Kugelev | |
| 2007/0007042 | A1 | 1/2007 | Gard | |
| 2014/0041622 | A1 * | 2/2014 | Yoshizawa | F04B 9/042 123/197.4 |
| 2015/0132157 | A1 * | 5/2015 | Whaley | F04B 47/02 417/321 |
| 2018/0045187 | A1 * | 2/2018 | Nagel | F04B 9/045 |
| 2018/0163710 | A1 * | 6/2018 | Bleisch | F04B 9/042 |
| 2018/0313351 | A1 * | 11/2018 | Dyer | F04B 49/22 |
| 2020/0332788 | A1 * | 10/2020 | Cui | F04B 53/16 |

OTHER PUBLICATIONS

Gardner—Denver, Mud Pumps, PO-7 & PV-9 Six Cylinder Single-Acting Piston & Plunger, pp. 1876-1877, at least as early as 1975, Quincy, Illinois.

* cited by examiner

*Primary Examiner* — Charles G Freay
*Assistant Examiner* — Chirag Jariwala
(74) *Attorney, Agent, or Firm* — Scott Griggs; Griggs Bergen LLP

(57) ABSTRACT

A mud pump is provided that includes a pump shaft having substantially circular eccentric lobes. Each lobe is rotatably mounted in a connecting rod that, in turn, moves a slide in a horizontal and linearly manner. A pony rod operatively couples a pump fluid end module to one or both sides of each slide frame and a pump fluid end module. As the pump shaft turns, each lobe causes the slide to move side to side. As the slide moves side to side, each pony rod operates a pump fluid end module whose outputs can be coupled to a common manifold.

36 Claims, 21 Drawing Sheets

MUD PUMP

CROSS REFERENCE TO FOREIGN PRIORITY APPLICATION

This application claims priority under 35 U.S.C. § 119 to Canadian Patent Application No. 3,043,739, entitled "Mud Pump," filed on May 17, 2019, in the name of Gerald Lesko; which is hereby incorporated by reference for all purposes.

TECHNICAL FIELD OF THE INVENTION

The present disclosure is related to the field of pumps in general and, in particular, pumps used in pumping drilling mud or "mud pumps".

BACKGROUND OF THE INVENTION

It is known to use pumps to provide drilling mud under pressure in the drilling of wells. Pressurized drilling mud is delivered down a hollow drill string as the well is being drilled to carry away cuttings up the annulus surrounding the drill string to ground level. Such drilling operations are well known to those skilled in the art.

Prior art pumps can use a motor to turn a crankshaft or "pump shaft" to convert rotary motion to a reciprocating motion. The pump shaft moves a connecting rod coupled to a crosshead that moves within a fixed crosshead slide to provide this conversion. The crosshead is coupled to a "pony rod" that provides the pumping motion in a pump fluid end module, as well known to those skilled in the art.

The above-mentioned mechanical arrangement can be multiplied so that a multitude or plurality of pump fluid end modules can be operated from a single pump shaft. The output of each pump fluid end module can be coupled to a common manifold from which pressurized drilling mud can be provided to the drill string. By coupling the pump fluid end module outputs to a common manifold, the pulsing of the pressure of the drilling mud can be reduced or smoothed out, this being a problem well known to those skilled in the art. The disadvantage of this mechanical arrangement is the size and complexity of the components involved to provide a multi-module pump.

It is also known in the oil and gas industry to drill horizontal wells. These are wells that are initially drilled vertically and, with the use of directional drilling equipment as well known to those skilled in the art, the direction of drilled well becomes horizontal or parallel with the ground surface. It is known to drill horizontal wells up to 5486 meters (18000 feet) in length or more. To do so requires the use of "mud motors", motors that are powered by the delivery of highly pressurized drilling mud pumped through the drill string so as to enable the turning of the drill bit. It is also known that to drill such wells, drilling operators will use at least two or more conventional mud pumps powered by 1000 horsepower or more motors. Each mud pump can be housed in its own pump house and occupies space at the drilling site. As each additional pump house increases the number of structures at a drilling site, the number of truckloads required to deliver the necessary equipment to a drilling site also increases. All this additional equipment and number of truckloads to deliver the equipment add cost to the drilling of the well.

In prior art mud pumps, an example of which is shown in FIG. 1, where bronze plates are used as the bearing surfaces for the horizontal side to side movement of the internal mechanism, an unwanted vertical force applies to the internal mechanism as a result of the crankshaft torque. This can cause undue and accelerated wear and friction on the bronze plates and to the pony rod bushings.

It is, therefore, desirable to provide a pump that can deliver pressurized mud at a volume equivalent to two or more conventional mud pumps without the shortcomings of the prior art technology.

SUMMARY OF THE INVENTION

A pump is provided that comprises a pump shaft having at least one eccentric lobe that is substantially circular. A motor is used to provide the rotational power to the pump shaft. In one embodiment, the motor can be coupled directly to the pump shaft. In another embodiment, a transmission can be used between the motor and the pump shaft to reduce the angular speed of the rotational power provided to the pump shaft. In a representative embodiment, a one or multi-stage transmission can be used as well known to those skilled in the art. In a further embodiment, the motor can be a 3-phase AC motor controlled by a variable frequency drive mechanism to control the speed of the motor.

In one embodiment of the pump, the eccentric lobe can be rotatably disposed within a connecting rod having a substantially circular opening to receive the lobe at one end with the other end rotatably pinned to a slide configured to move in a horizontal and linear manner. In one embodiment, the slide can roll along a support wheel, wherein the wheel ca support the slide to counter the effects of the downward vertical force caused by the crankshaft torque as the slide moves in a linearly and horizontal or side-to-side manner. In one embodiment, the support wheel can be rotatably disposed on an axle coupled to the supporting frame so that the slide can move side-to-side with minimal friction. In another embodiment, the support wheel can roll along a lower track disposed on the bottom of the support frame, wherein the lower track can comprise means for adjusting a loading force on the support wheel against the slide to minimize any gap therebetween so that the slide is constrained to horizontal and linear movement. The support wheel can also center the pony rod in its housing and minimize wear on a wear band deposed therein.

As the lobe rotates within the connecting rod opening, the connecting rod slide can move up and down thereby moving the slide linearly and horizontally along the support wheel. As the slide frame moves side to side, it can move a pony rod in and out to operate a pump fluid end module. By virtue of this configuration, the slide can have a pony rod operatively coupled to one or both opposing sides of the slide. Therefore, a single slide can operate one or two pump fluid end modules at the same time. In a further embodiment, the pump shaft can comprise a plurality of eccentric lobes thereby allowing a plurality of slides to be operated by the lobes and, hence, a plurality of pump fluid end modules to be operated from a single rotating pump shaft.

Broadly stated, in some embodiments, a mud pump is provided, comprising: a frame; at least one pump fluid end module disposed on the frame, the at least one pump fluid end module comprising an inlet port and an outlet port; a pump shaft rotatably disposed in the frame for receiving rotational power from a motor, the pump shaft having at least one substantially circular eccentric lobe disposed thereon, the centre of the at least one eccentric lobe displaced or offset from the longitudinal axis of the pump shaft; at least one slide disposed in the frame, the at least one slide operatively configured to move linearly side-to-side within the frame; at least one pony rod assembly operatively coupling the at least one slide to the at least one pump fluid end module; and a connecting rod comprising first and second ends operatively coupling the pump shaft to the at least one slide, the first end rotatably disposed on the at least one eccentric lobe, the second end rotatably pinned to the at least one slide whereby rotation of the pump shaft causes the slide to move side-to-side that, in turn, causes the at least one pony rod assembly to operate the at least one pump fluid end module; and a support mechanism disposed beneath and operatively coupled to the at least one slide, the support mechanism rotatably coupled to the frame.

Broadly stated, in some embodiments, a mud pump is provided, comprising: a platform; a lattice frame disposed on the platform; at least one pump fluid end module disposed on the frame, the at least one pump fluid end module comprising an inlet port and an outlet port; a pump shaft rotatably disposed in the frame for receiving rotational power from a motor, the pump shaft having at least one substantially circular eccentric lobe disposed thereon, the centre of the at least one eccentric lobe displaced or offset from the longitudinal axis of the pump shaft; a motor operatively coupled to the pump shaft, the motor disposed on the platform; at least one slide disposed in the frame, the at least one slide operatively configured to move linearly side-to-side within the frame; at least one pony rod assembly operatively coupling the at least one slide to the at least one pump fluid end module; and a connecting rod comprising first and second ends operating coupling the pump shaft to the at least one slide, the first end rotatably disposed on the at least one eccentric lobe, the second end rotatably pinned to the at least one slide whereby rotation of the pump shaft causes the slide to move side-to-side that, in turn, causes the at least one pony rod assembly to operate the at least one pump fluid end module; and a support mechanism disposed beneath and operatively coupled to the at least one slide.

Broadly stated, in some embodiments, the support mechanism can comprise a support wheel rotatably disposed beneath the at least one slide, the at least one slide configured to roll along on top of the support wheel.

Broadly stated, in some embodiments, the support wheel can comprise an anti-skidding engagement mechanism.

Broadly stated, in some embodiments, the anti-skidding engagement mechanism can comprise a plurality of anti-skidding balls disposed on one of the support wheel and the at least one slide, and a plurality of corresponding pockets disposed on the other of the support wheel and the at least one slide.

Broadly stated, in some embodiments, the support wheel can be rotatably disposed on an axle operatively coupled to the frame.

Broadly stated, in some embodiments, the plurality of anti-skidding balls can be disposed around a circumference of the support wheel and the plurality of corresponding pockets are disposed along a lower edge of the at least one slide.

Broadly stated, in some embodiments, the support wheel can be rotatably disposed on an adjuster mechanism, the adjuster mechanism comprising a fixed wedge and an overlapping moving wedge, the combination of which can raise or lower the support wheel relative to the at least one slide.

Broadly stated, in some embodiments, the plurality of anti-skidding balls can be disposed along a lower edge of the at least one slide and the plurality of corresponding pockets are disposed around a circumference of the support wheel.

Broadly stated, in some embodiments, the mud pump can further comprise transmission operatively disposed between the motor and the pump shaft thereby coupling the motor to the pump shaft.

Broadly stated, in some embodiments, the transmission can further comprise a single-stage or a multi-stage transmission.

Broadly stated, in some embodiments, the motor can comprise a 3-phase alternating current electric motor.

Broadly stated, in some embodiments, the mud pump can further comprise an intake manifold operatively coupled to the inlet port of the at least one pump fluid end module, the intake manifold providing communication between an intake manifold inlet and the inlet port of the at least one pump fluid end module.

Broadly stated, in some embodiments, the mud pump can further comprise an outlet manifold operatively coupled to the outlet port of the at least one pump fluid end module, the outlet manifold providing communication between the outlet port of the at least one pump fluid end module and an outlet manifold outlet.

Broadly stated, in some embodiments, the at least one pony rod assembly can further comprise: a pony rod support bushing configured to be disposed on the frame; a piston liner comprising first and second ends, the second end operatively coupled to the at least one pump fluid end module; and a pony rod slidably disposed in the support bushing, the pony rod comprising first and second ends, the first end operatively coupled to the at least one slide, the second end further comprising a piston slidably disposed in the piston liner thereby forming a liner chamber disposed between the piston and the support bushing.

Broadly stated, in some embodiments, the pony rod support bushing can further comprise means for circulating coolant and lubricant through the liner chamber.

Broadly stated, in some embodiments, the pony rod support bushing can further comprise means for lubricating the pony rod.

Broadly stated, in some embodiments, the pony rod assembly can further comprise: a pony rod support bushing configured to be disposed on the frame; a stuffing box disposed in the at least one pump fluid end module; and a pony rod slidably disposed in the support bushing, the pony rod comprising first and second ends, the first end operatively coupled to the at least one slide, the second end further comprising a plunger slidably disposed in the stuffing box.

Broadly stated, in some embodiments, the mud pump can further comprise a pump house wherein the mud pump is disposed in the pump house.

DETAILED DESCRIPTION OF THE INVENTION

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

Referring to FIGS. 2 to 14, one embodiment of a mud pump is illustrated. In this embodiment, mud pump 10 can comprise lattice frame 18 and pump fluid end modules 24 mounted thereon. Frame 18 can further comprise mounting tabs 14 for attaching mud pump 10 to a platform, to a skid or to a pump house.

Figure 2:
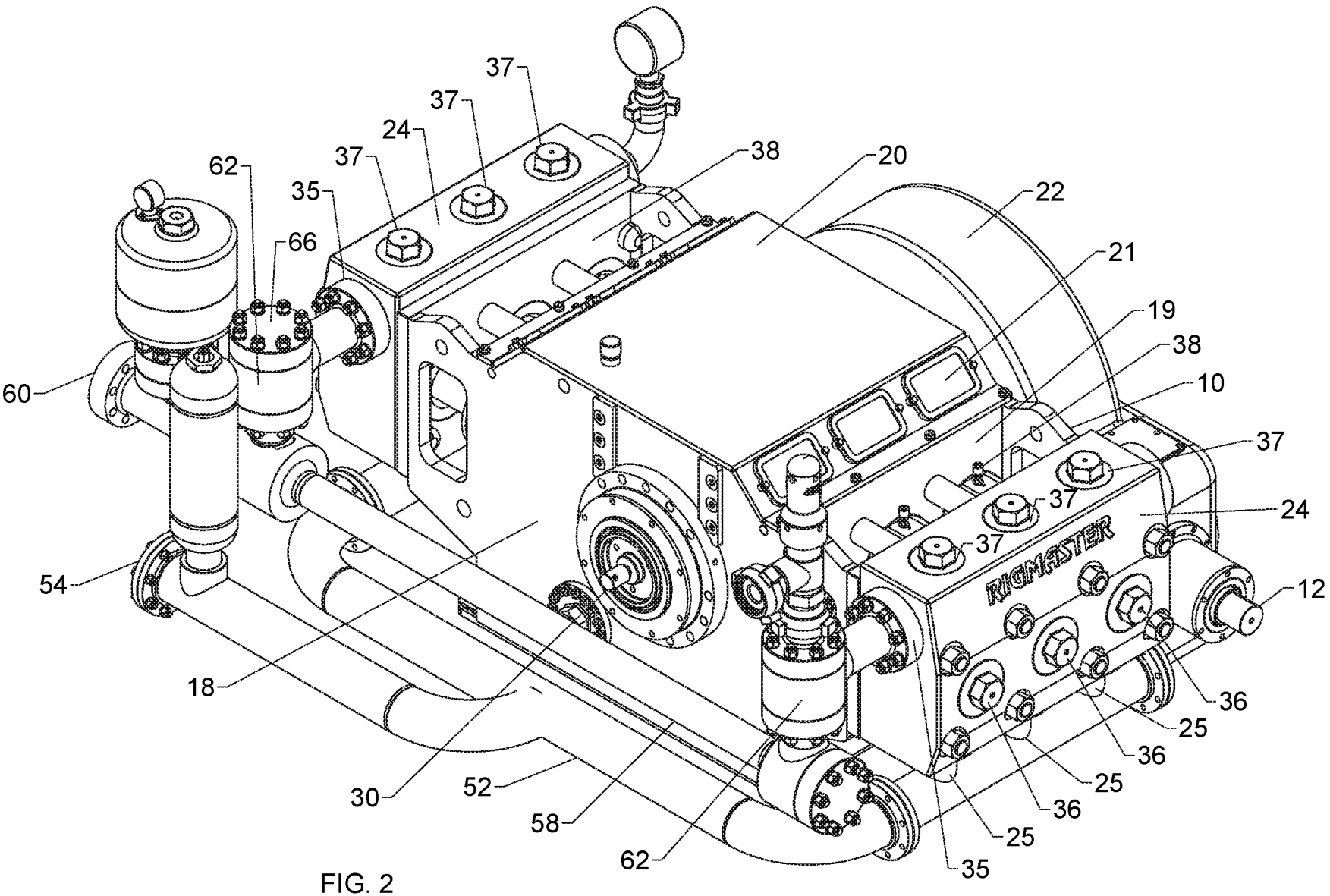
FIG. 2 is a rear perspective view depicting a mud pump having three slides, operating six pump fluid end modules in total.
Figure 6:
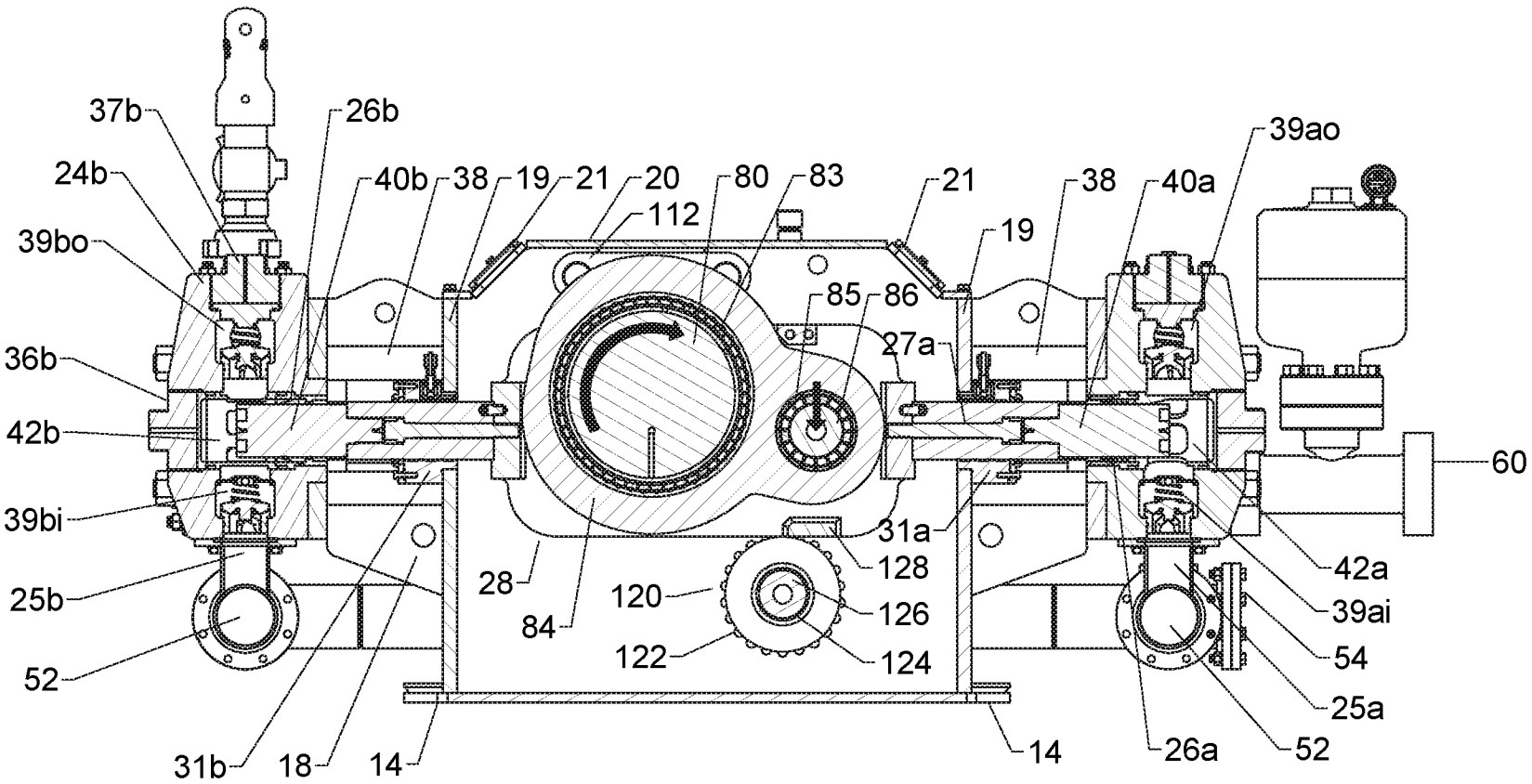
FIG. 6 is a front cross-sectional elevation view depicting the mud pump of FIG. 2 with the connecting rod moving downwards.
Figure 7:
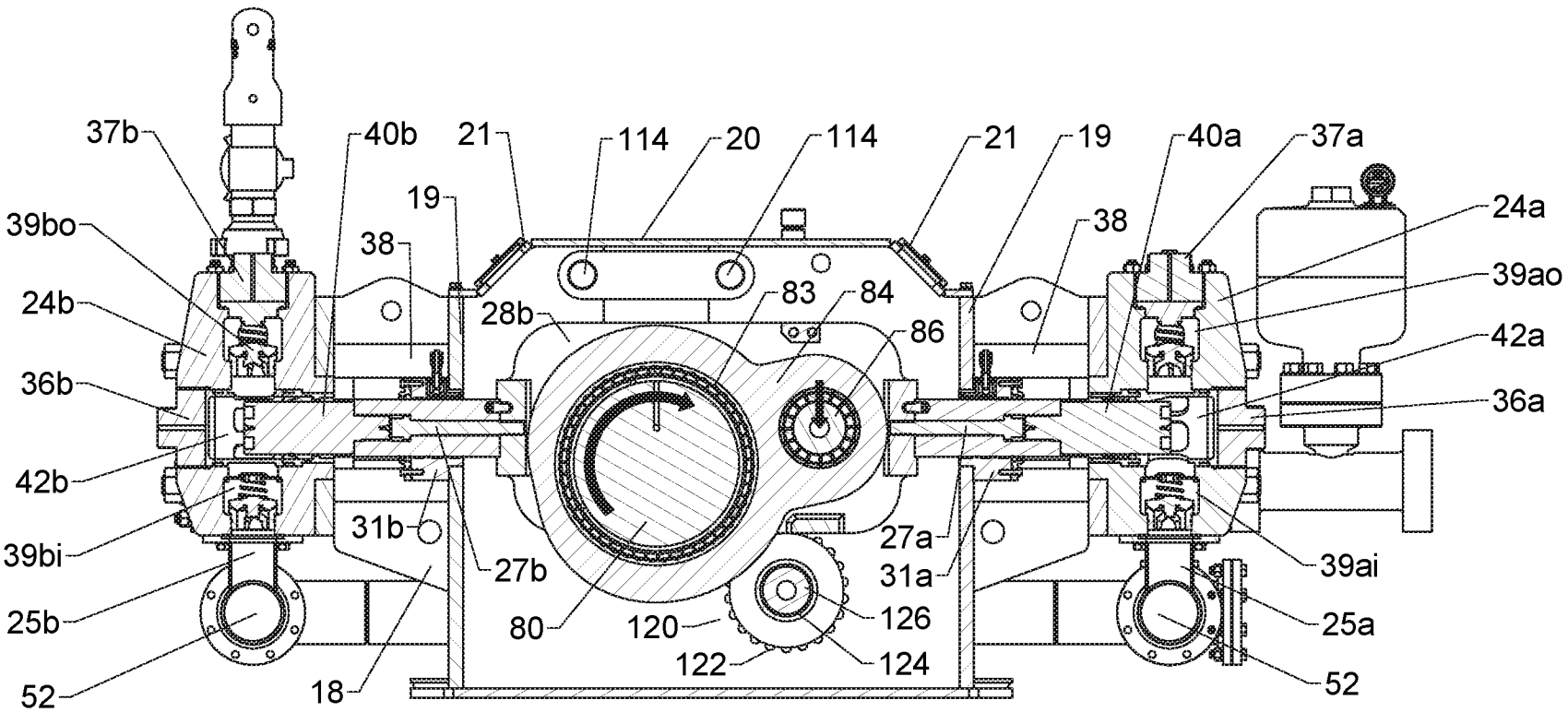
FIG. 7 is a front cross-section elevation view depicting the mud pump of FIG. 2 with the connecting rod moving upwards.

For the purposes of this specification, and as shown specifically in the figures, each pump fluid end module 24 can comprise inlet port 25, outlet port 35, top access port 37 (shown as 37*a* and 37*b* in FIGS. 6 and 7) and side access port 36 (shown as 36*a* and 36*b* in FIGS. 6 and 7). Pump fluid end module 24, as illustrated, can be any suitable pump fluid end module that is readily available to the mud pump industry and is well known to those skilled in the art. As shown in FIG. 2, pump fluid end module 24 is shown as a singular device having three pump units disposed therein (shown as 24*a* in FIG. 7). It is obvious to those skilled in the art that pump fluid end module 24 can comprise one or more pump units use in combination. Representative examples of pump fluid end module 24 are pump fluid end modules having an 800 horsepower rating as manufactured by Continental Emsco in the U.S.A. or their equivalent. Such pumps have interchangeable liners of different diameters whereby the volume of mud handled by a pump fluid end module per pump cycle can be adjusted upwards or downwards depending on the diameter of the liner. Generally speaking, the smaller the volume per pump fluid end module, the greater the pressure the mud can be pumped at.

Referring to FIG. 2, mud pump 10 is shown having cover 20 disposed on top of lattice frame 18. Input shaft 12 can be connected to a motor (not shown) to provide rotational input power to mud pump 10. In some embodiments, an internal combustion motor can be used to provide rotational input power to mud pump 10. In other embodiments, an electric motor of suitable power rating can be used. In further embodiments, a variable frequency drive mechanism (not shown) as well known to those skilled in the art can be used to control the electrical power provided to the electric motor thereby controlling the rotational speed the motor operates at to supply rotational input power to mud pump 10.

In one embodiment, mud pump 10 can comprise transmission 22 to couple shaft 12 to the operating components of mud pump 10. Transmission 22 can be a single-stage or multi-stage transmission to reduce the rotational speed of input shaft 12 to the required rotational speed for proper operation of pump shaft 30 rotatably disposed in mud pump 10. In other embodiments, transmission 22 can comprise a planetary gear transmission. In further embodiments, transmission 22 can comprise helical gears. In yet other embodiments, transmission 22 can comprise spur gears. Intake manifold 52, comprising inlet 54, is shown attached to pump fluid end module inlet ports 25 (shown as 25*a* and 25*b* in FIGS. 6 and 7). Outlet manifold 58, comprising couplers 62 and end caps 66, is shown attached to pump fluid end module outlet ports 35.

Figure 3:
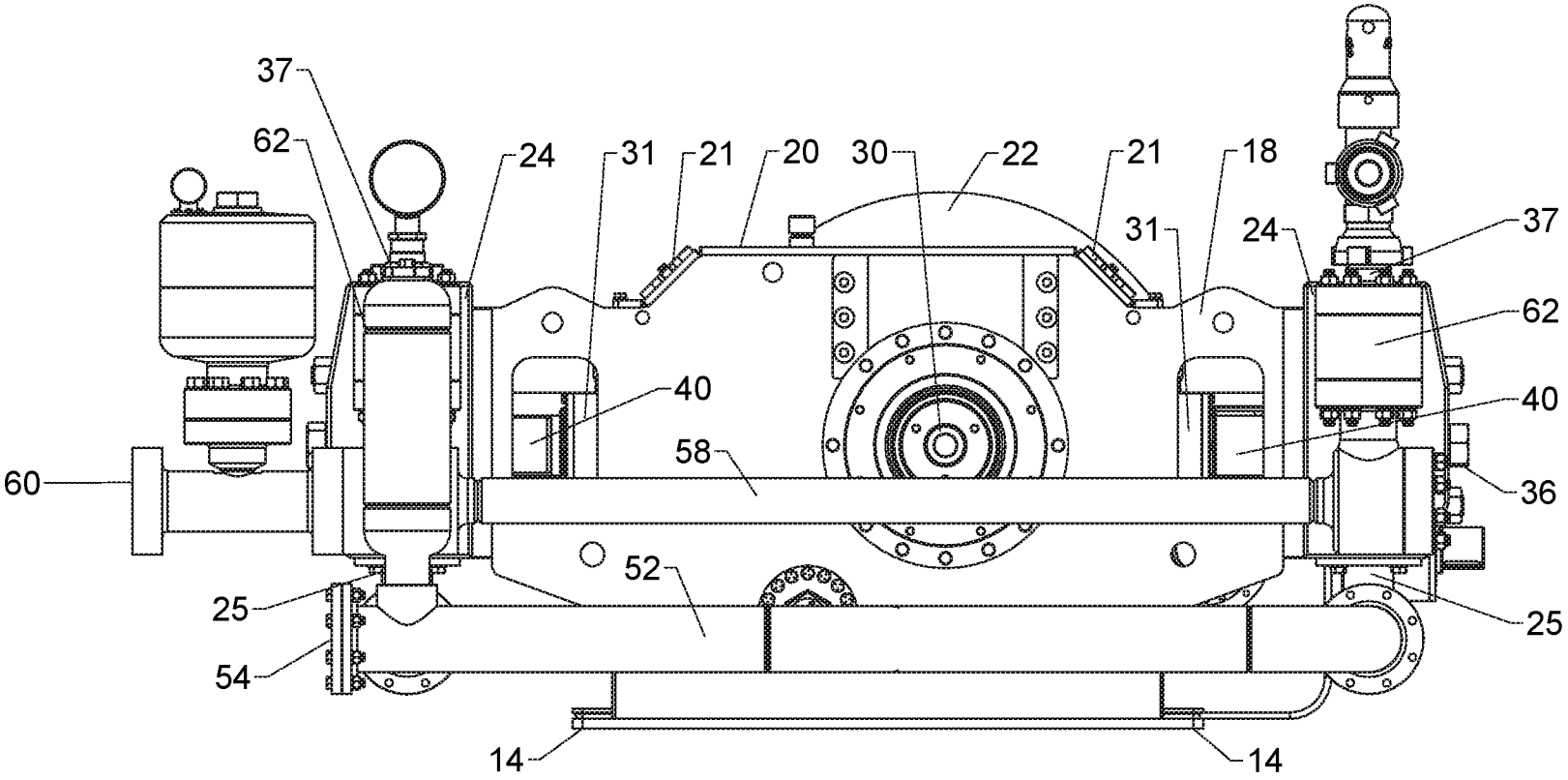
FIG. 3 is a rear elevation view depicting the mud pump of FIG. 2.

Referring to FIG. 3, a rear elevation view of mud pump 10 is shown. In this figure, pony rod support bushings 31 are shown disposed on sidewalls 19 of frame 18 (shown as 31*a* and 31*b* in FIGS. 6 and 7).

Figure 4:
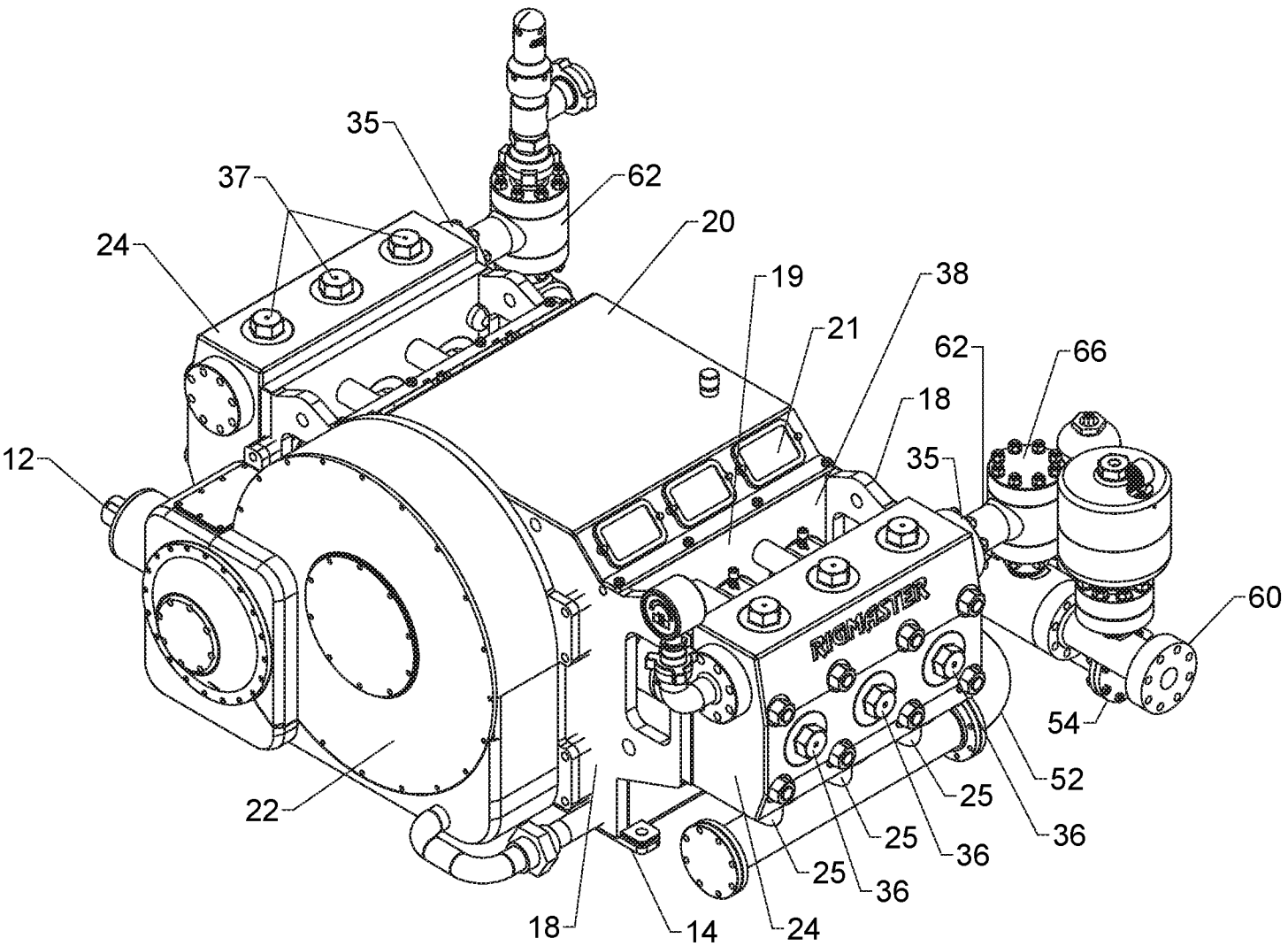
FIG. 4 is a front perspective view depicting the mud pump of FIG. 2.
Figure 5:
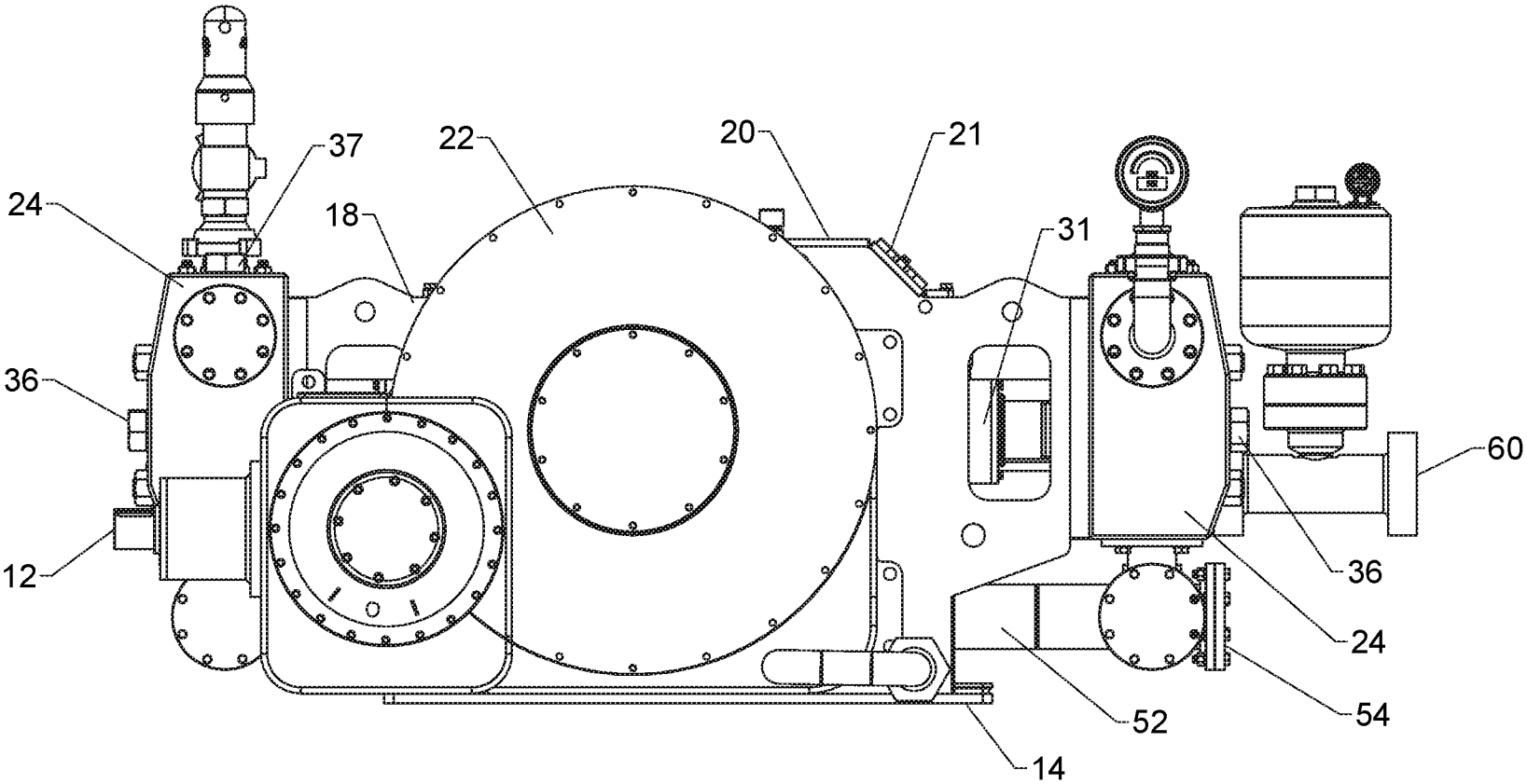
FIG. 5 is a front elevation view depicting the mud pump of FIG. 2.

Referring to FIGS. 4 and 5, front views of mud pump 10 are shown. In one embodiment, pump fluid end module 24 can comprise "sucker-cup" pump mechanisms as well known to those skilled in the art. In the illustrated embodiment, an output manifold (not shown) can be attached to the shown outlet ports 35 to collect drilling mud pumped by pump fluid end module 24, in addition to outlet manifold 58 shown in FIGS. 2 and 3, or it can be capped with a cover (not shown). Input ports 25 can be coupled together with intake manifold 52 that directs drilling mud into pump fluid end modules 24.

Figure 10:
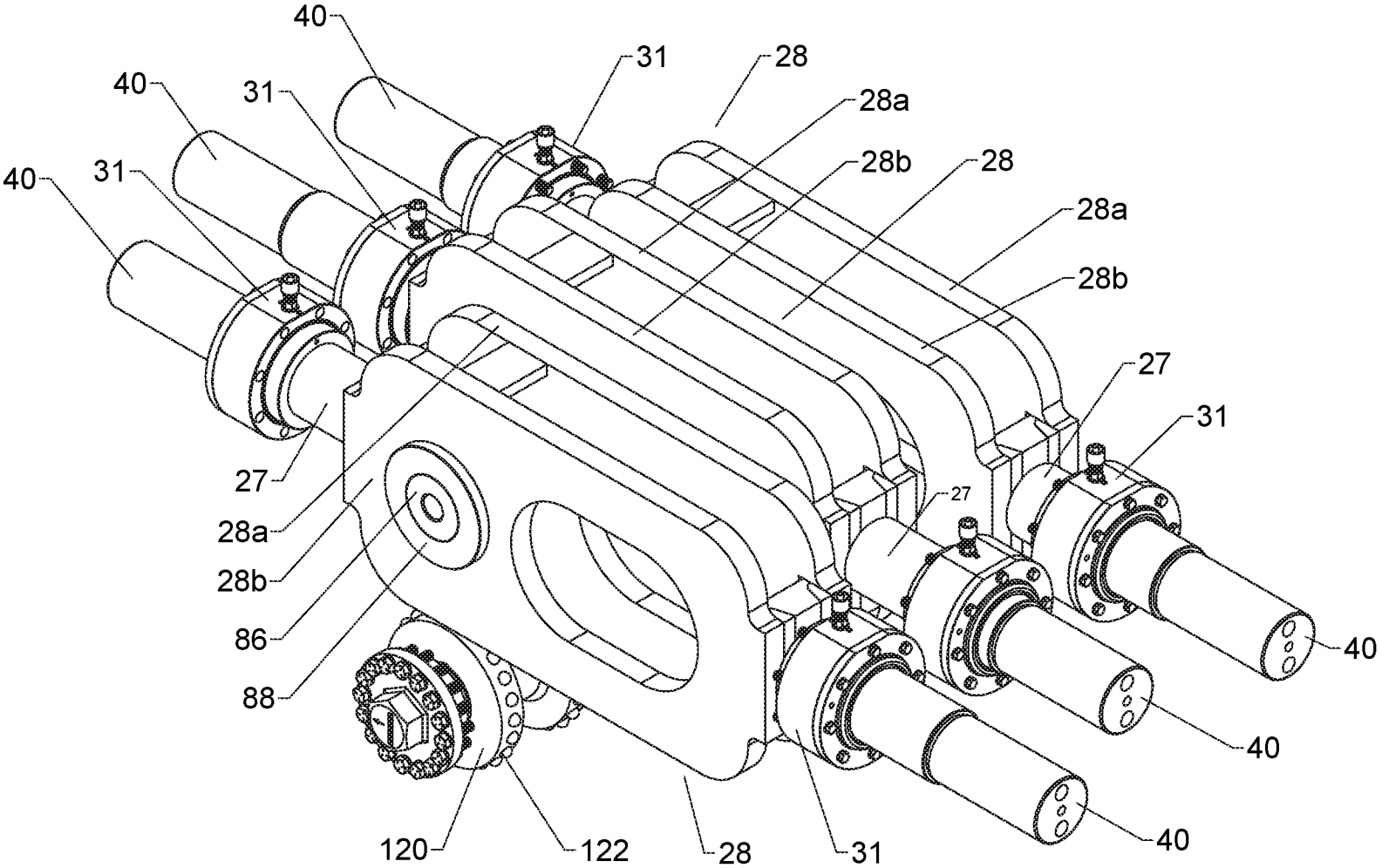
FIG. 10 is a perspective view of the mud pump of FIG. 9 with the frame removed.
Figure 11:
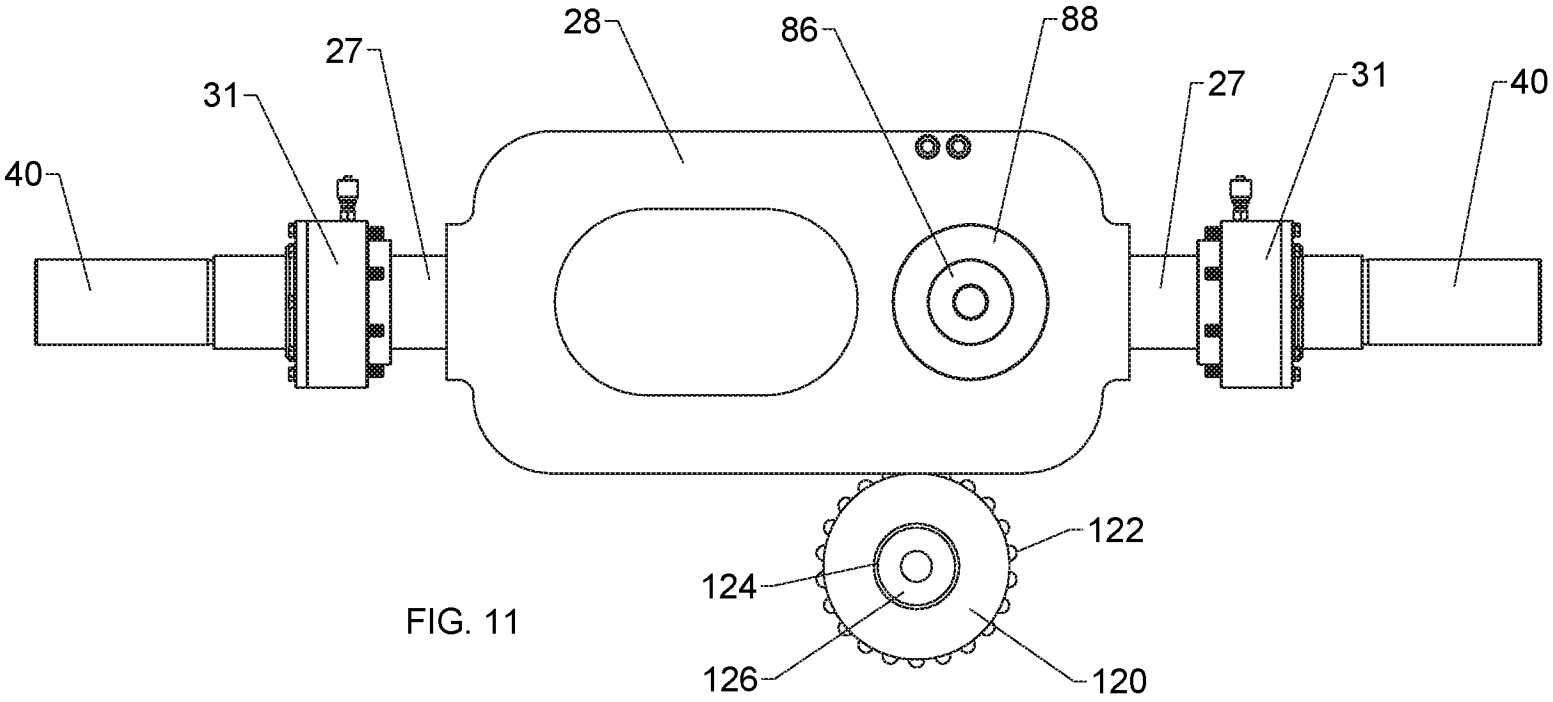
FIG. 11 is a front elevation view of the mud pump of FIG. 10.
Figure 12:
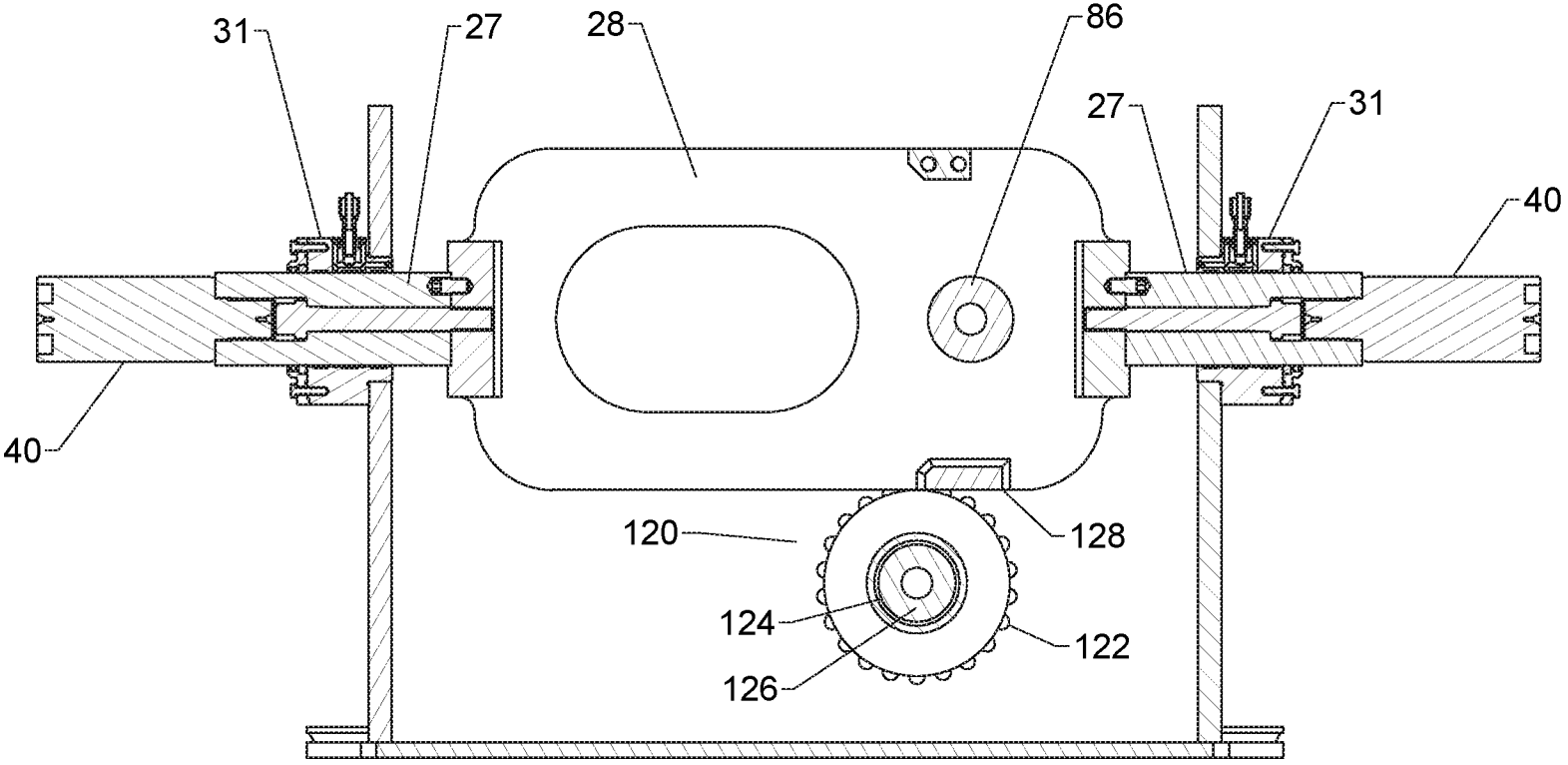
FIG. 12 is a front cross-sectional view of the mud pump of FIG. 9.
Figure 14:
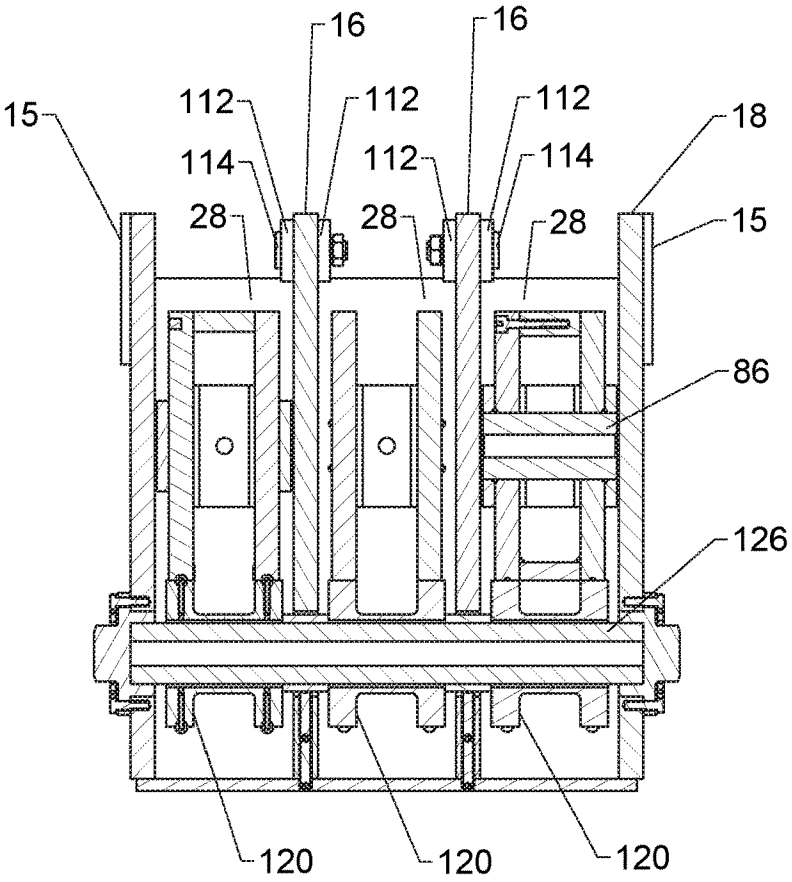
FIG. 14 is a side cross-section elevation view depicting the mud pump of FIG. 13.
Figure 13:
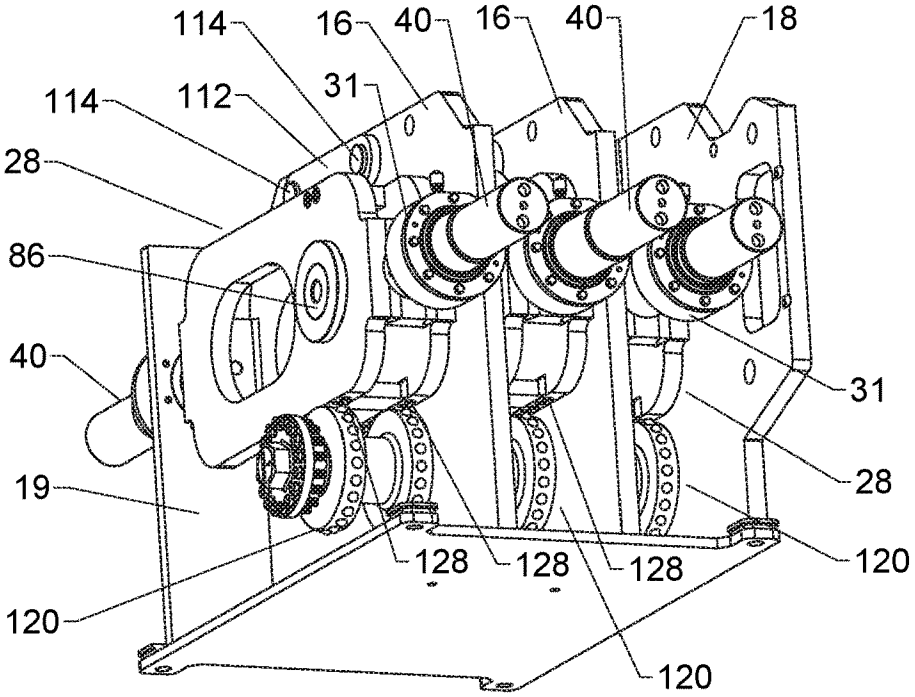
FIG. 13 is a partial bottom perspective view depicting the mud pump of FIG. 9.

Referring to FIGS. 6 and 7, front cross-section views of mud pump 10 are shown revealing the internal components of the embodiment shown therein. In this embodiment, pump shaft 30 rotates as a result of input rotational power applied to input shaft 12 that is operatively coupled to pump shaft 30 via transmission 22 as shown in FIG. 5. In one embodiment, pump shaft 30 can comprise eccentric 80 disposed thereon. Rotatably disposed on eccentric 80 is connecting rod 84. In another embodiment, eccentric bearing 83 is disposed between eccentric 80 and connecting rod 84. In a further embodiment, connecting rod 84 is rotatably pinned to sidewall 28*b* (and to sidewall 28*a* as shown in FIG. 10) of slide via pin 86. In yet another embodiment, bearing 85 can be disposed between pin 86 and connecting rod 84. Mud pump 10 can comprise at least one sight glass 21 to permit visual inspection therein, as shown in FIGS. 2 to 7.

In FIG. 6, eccentric 80 is shown rotating clockwise thereby moving connecting rod 84 to the right in this figure. In so doing, slide 28 is being pushed to the right. In some embodiments, mud pump 10 can comprise a support mechanism configured for countering the unwanted vertical force as described above and shown in FIG. 1. In some embodiments, the support mechanism can comprise support wheel 120 disposed beneath slide 28 whereupon slide 28 can roll along on top of support wheel 120. As shown in more detail in FIGS. 8A and 8B, support wheel 120 can be comprised of tubular-shaped hub 130. As shown in FIGS. 6, 7 and 9 to 14, wheel 120 can be rotatably disposed on axle 126 disposed between sidewalls 28*a* and 28*b* of slide 28. In some embodiments, bushing 124 can be disposed between axle 126 and wheel 120 as a bearing to minimize friction as wheel 120 rotates on axle 126.

In some embodiments, the support mechanism can comprise an anti-skidding engagement mechanism with slides 28. In some embodiments, the anti-skidding engagement mechanism can comprise a plurality of anti-skidding balls 122 disposed around the circumference of hub 130 of wheel 120 in a substantially equally spaced-apart configuration. In some embodiments, wheel 120 can comprise two such sets of the plurality of anti-skidding balls 122, one disposed near each end of hub 130. In embodiments, anti-skidding balls 122 can be comprised of spheres of steel or similarly hard material. In some embodiments, a series of holes 136 can be drilled through hub 130, then a concave pocket can be drilled or machined on the outer surface of hub 130 at each hole 136 wherein each of the concave pockets is configured to receive an anti-skidding ball 122. Each hole 136 can then be tapped so as to be able to receive set screws 134, in a manner well known to those skilled in the art. Similarly, each anti-skidding ball 122 can be drilled and tapped to receive a set screw 134. In some embodiments, to assemble 120, the anti-skidding balls 122 are placed in the concave pockets disposed on hub 130 and then secured thereto by set screw 134 being through hole 136 into anti-skidding ball 122, with each set screw 134 being tightened so that anti-skidding balls 122 are secured to hub 130. In some embodiments, set screws 134 can be further secured using a thread-locking liquid, such as Loctite® or similar substance as well known to those skilled in the art. In some embodiments, after anti-skidding balls 122 have been attached to hub 130, bushing 124 can then be pressed into the interior opening of hub 130, in a manner as well known to those skilled in the art.

Figure 1:
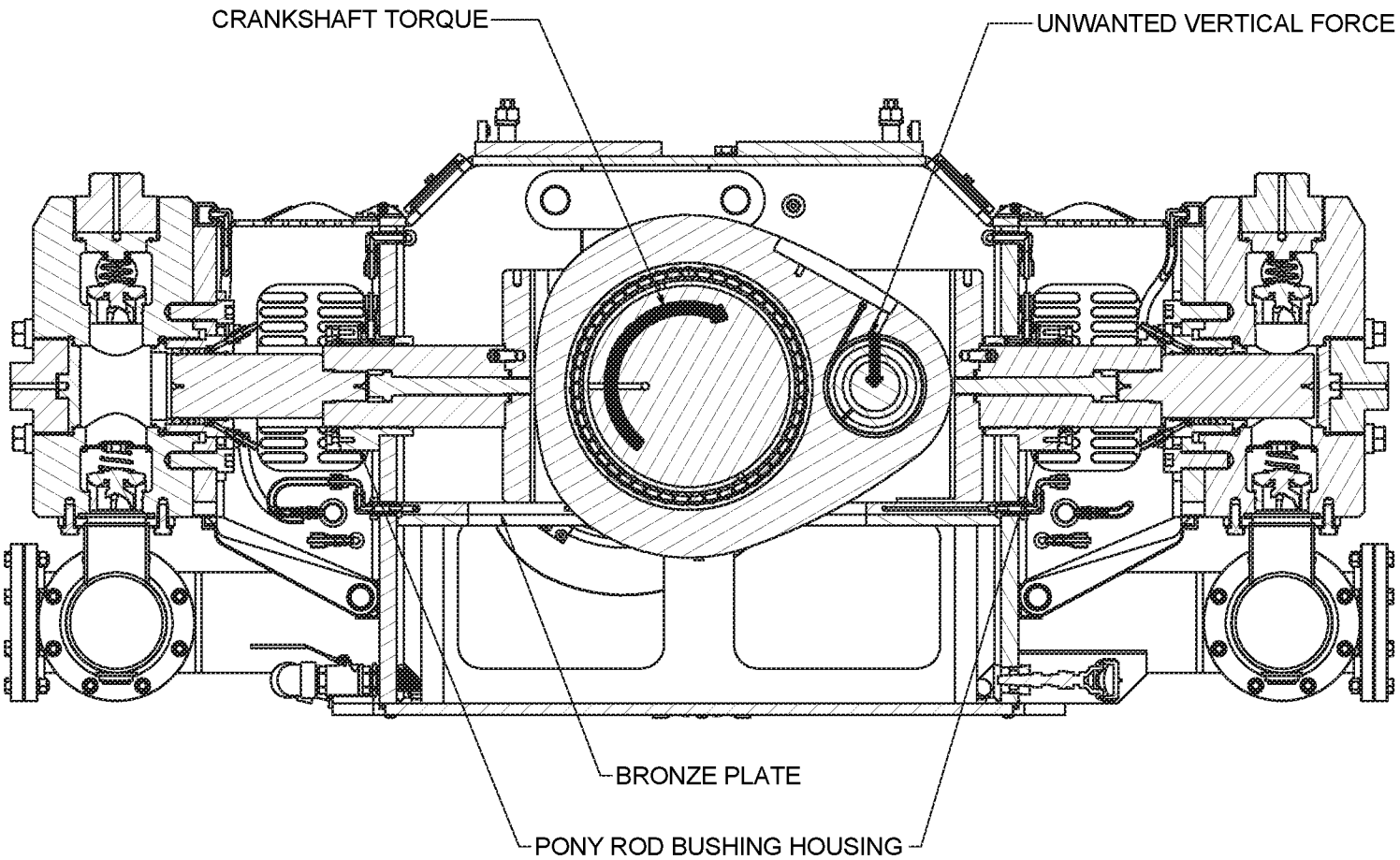
FIG. 1 (PRIOR ART)
FIG. 1 is a front cross-section elevational view depicting a prior art mud pump.
Figure 8C:
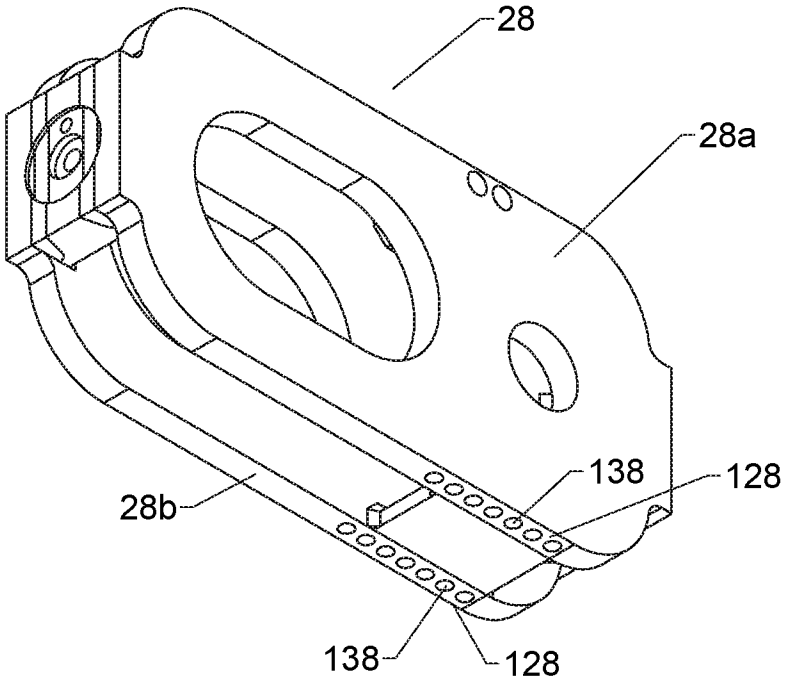
FIG. 8C is a perspective view depicting a slide of the mud pump of FIG. 6.
Figure 8A:
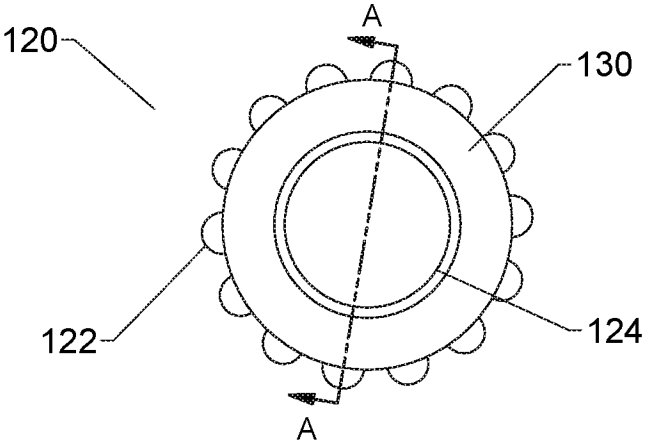
FIG. 8A is an end elevation view depicting the support wheel of the mud pump of FIG. 6.
Figure 8B:
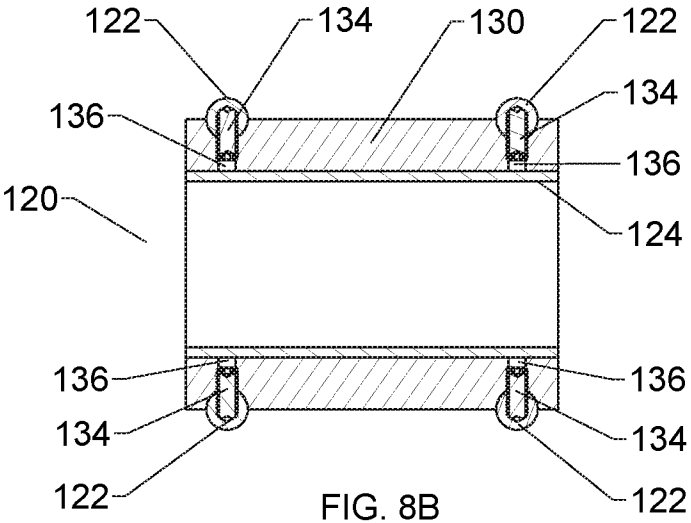
FIG. 8B is a cross-section elevation view depicting the support wheel of FIG. 8A along section lines A-A.

In some embodiments, one or both of sidewalls 28*a* and 28*b* can comprise track 128 disposed along a lower edge thereof, each track 128 comprising a plurality of substantially equally spaced-apart pockets 138 (as shown in FIG. 8C) wherein the spacing of pockets 138 substantially corresponds to the spacing of anti-skidding balls 122 disposed around wheel 120. When slide 28 is assembled into frame 18, pockets 138 on each track 128 can be fitted on corresponding anti-skidding balls 122 on wheel 120 such that slide 28 can roll along wheel 120 in a horizontal linear path from left to right and vice-versa. This configuration can further resist the bending moment caused by the rotation of pump shaft 30 and eccentric 80 as wheel 120 can counter the unwanted vertical force as shown in FIG. 1 in the prior art mud pump. In the illustrated embodiment, each of sidewalls 28*a* and 28*b* comprises a track 138 for engaging corresponding anti-skidding balls 122 disposed around a single wheel 120. In other embodiments, it is possible that only one of sidewall 28*a* and 28*b* can comprise a track 138, with corresponding anti-skidding balls 122 disposed around one end of hub 130 of wheel 120. In other embodiments, it possible that more than one support wheel 120 can be implemented to counter the unwanted vertical force that can be imparted on slide 28. In other embodiments, the anti-skidding engagement mechanism can comprise alternate mechanisms for the engagement between slide 28 and support wheel 120, which can comprise but are not limited to straight-cut gear teeth similar to a rack and pinion system as well known to those skilled in the art, angle-cut gear teeth, chain and sprocket profiles disposed onto wheel 120 and lower edge of slide 28, v-shaped profiles disposed onto wheel 120 and lower edge of slide 28, anti-skid elastomeric or rubber material disposed on wheel 120 and lower edge of slide 28, a rail channel disposed on either of wheel 120 and slide 28 wherein one of wheel 120 and slide 28 can be disposed within the rail channel disposed on the other of wheel 120 and slide 28, as well as any other anti-skidding engagement mechanism as well known to those skilled in the art.

Referring to FIG. 6, as slide 28 moves to the right, it pushes pony rod 27*a* and, hence, plunger 40*a* to the right in stuffing box 26*a* to push fluids in pump chamber 42*a* out through valve 39*ao* to outlet ports 35 (not shown) and outlet manifold 58 (not shown). In so doing, pony rod 27*b* also pulls plunger 40*b* in stuffing box 26*b* to the right thereby drawing in fluid through valve 39*bi* from intake manifold 52.

In FIG. 7, eccentric 80 is shown rotated further clockwise (from FIG. 6) thereby moving connecting rod 84 to the left. In so doing, plunger 40*a* is being pulled to the left thereby drawing in fluid into pump chamber 42*a* through valve 39*ai* from intake manifold 52 while plunger 40*b* is pushed to the left thereby pushing fluid out of pump chamber 42*b* through valve 39*bo* to outlet ports 35 (not shown) and outlet manifold 58 (not shown).

Figure 9:
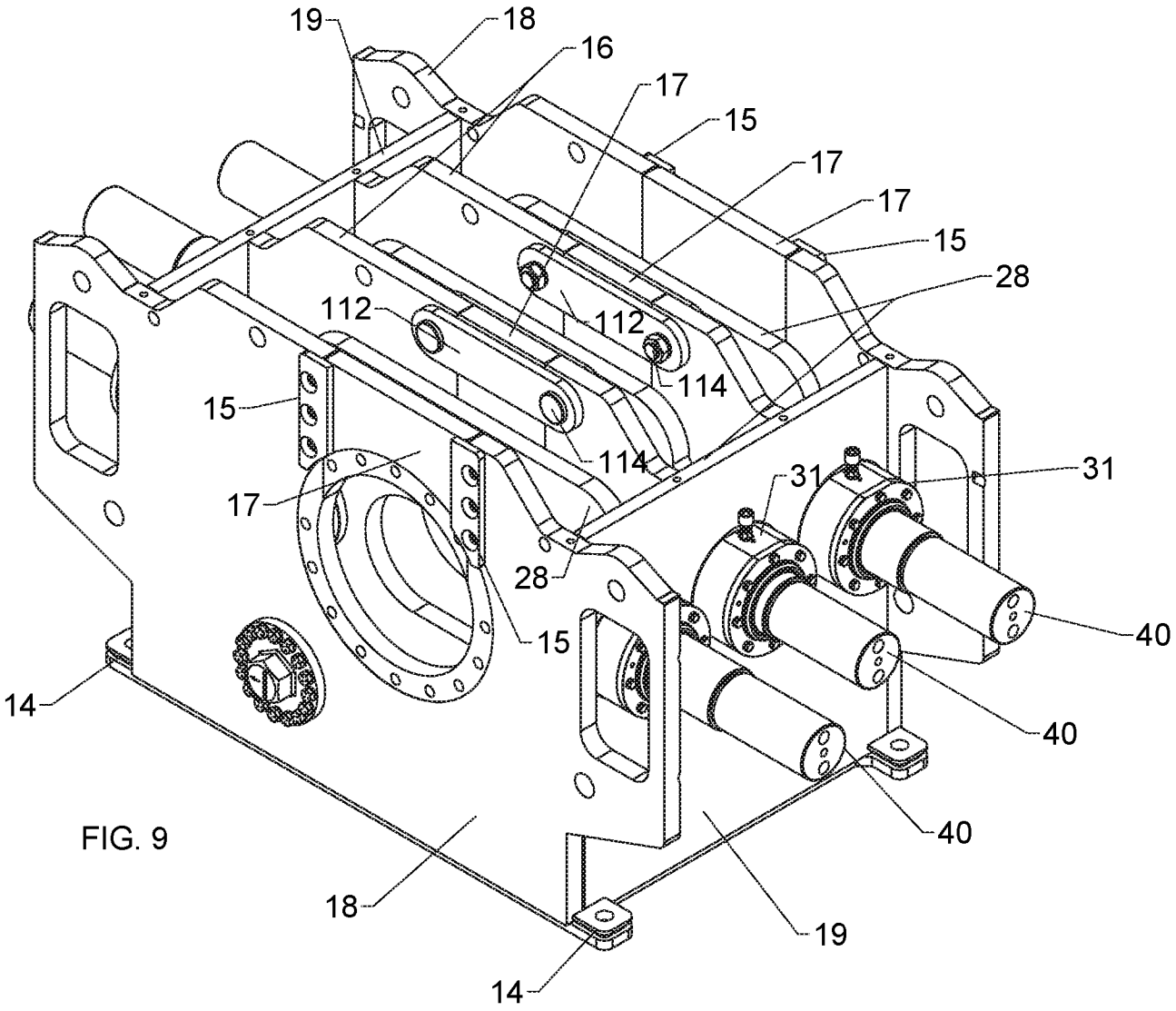
FIG. 9 is a rear perspective view depicting a partial assembly of the mud pump of FIG. 6 showing only the frame, the slides and the plungers.

Referring to FIG. 9, mud pump 10 is shown without pump fluid end modules 24, cover 22, piston liners 26, pump shaft 30 and connecting rods 84. In this illustrated embodiment, frame sidewalls 19 are visible as are removable caps 17, which are configured hold pump shaft 30 in place in frame 18. In some embodiments, retainer caps 15 can be attached to the outer walls of frame 18 to further secure removable caps 17. With respect to interior walls 16, removable caps 17 can further secured thereto with straps 112 with threaded fasteners 114. With this configuration, caps 117 can add strength and stiffness to frame 18.

Referring to FIG. 10, the mud pump 10 of FIG. 9 is now shown with frame 18 removed to reveal slides 28. In some embodiments, each slide 28 can comprise a pair of substantially parallel spaced-apart sidewalls 28*a* and 28*b*, as shown in FIGS. 10 to 14. In some embodiment, each slide 28 can comprise openings 29 disposed through sidewalls 28*a* and 28*b* for pump shaft 30 (not shown) to pass through and pin boss 88 disposed through sidewalls 28*a* and 28*b* that are configured to receive connecting rod pins 86.

Figure 15A:
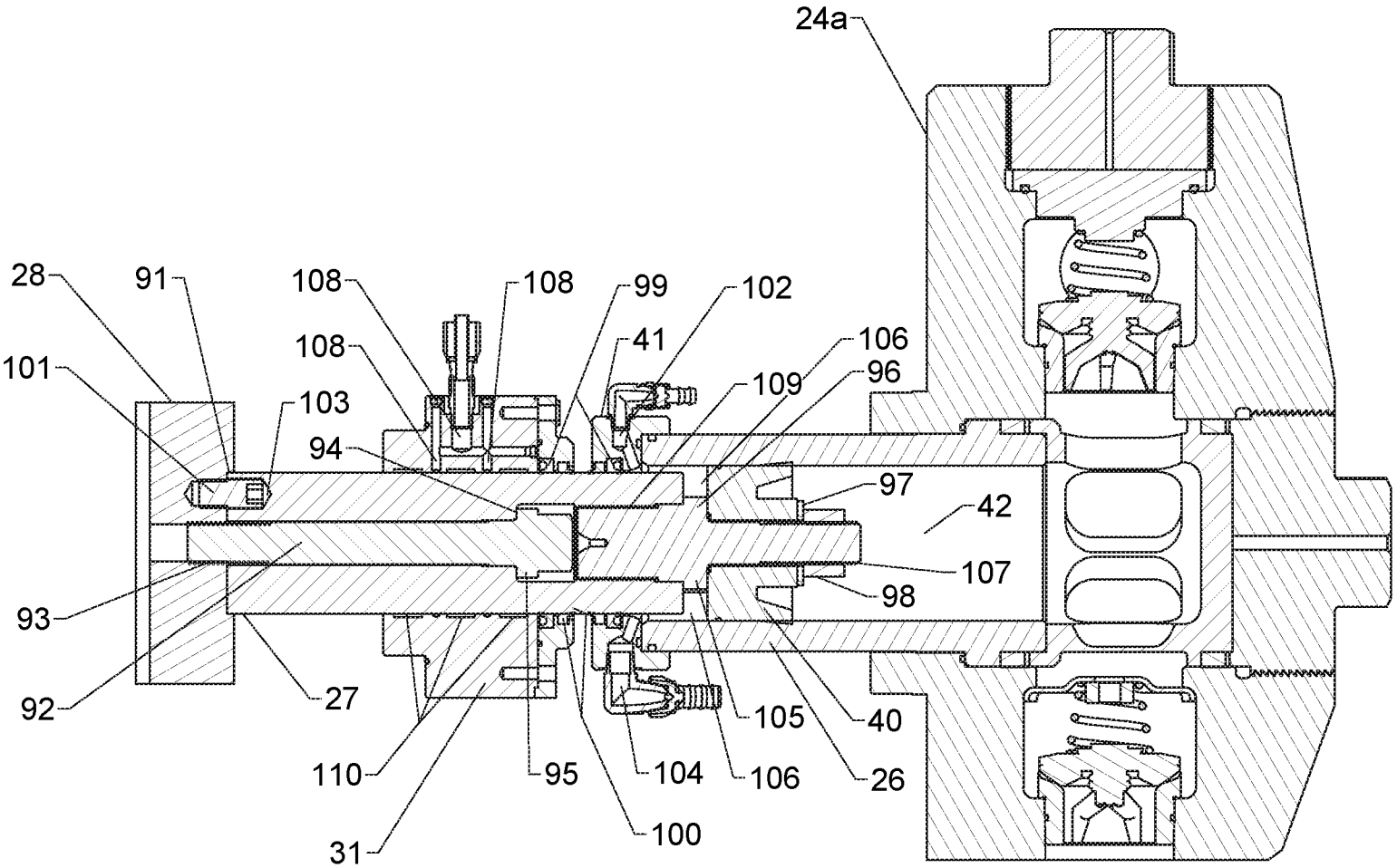
FIG. 15A is a front cross-section view depicting one pony rod assembly of a mud pump comprising a piston-style pump fluid end module.

Referring to FIG. 15A, a cross-section view is shown of a piston embodiment of the internal pumping mechanism of mud pump 10. In some embodiments, pony rod 27 can be coupled to slide 28 by placing pony rod 27 into opening 91 disposed on slide 28. In some embodiments, pony rod 27 can be further secured with pin 101 disposed on slide 28, wherein pin 101 is configured to fit within opening 103 disposed in pony rod 27 to prevent rotation thereof in opening 91. In some embodiments, pony rod stud 92 can be disposed in an opening disposed through pony rod 27 and secured to slide 28 in threaded opening 93. In some embodiments, pony rod stud 92 can further comprise flange 95 that can rest against shoulder 94 disposed within pony rod 27. In some embodiments, piston rod 96 can be threaded into threaded opening 109 of pony rod 27, wherein rod 96 can comprise flange 105 upon which piston 40 can be secured thereto by nut 98 threaded onto threaded end 107 of rod 96. Washer 97 can be sandwiched between nut 98 and rod 96.

In some embodiments, mud pump 10 can comprise means for circulating coolant in piston liner 26 behind piston 40 to prevent overheating of the mechanism when in operation. As shown in FIG. 15A, coolant can be pumped by a coolant pump (not shown) into liner chamber 106 through coolant inlet 102 disposed in coupler 41 via lines, hoses or piping (not shown). Coolant can the flow through, and circulate within, chamber 106 and then exit through coolant outlet 104. Lines, hoses and piping (not shown) can be coupled to outlet 104 so that the heated coolant can be collected, cooled and re-circulated, all as well known to those skilled in the art. In some embodiments, inlet 102 and outlet 104 can further comprise one-way valves, such as ball-valves as one example obvious to those skilled in the art, such that coolant can be drawn into chamber 106 through inlet 102 as piston 40 is moving towards pump fluid end module 24 (not shown), and then expelled from chamber 106 through outlet 104 and piston 40 is moving away from pump fluid end module 24.

In some embodiments, mud pump 10 can comprise means for circulating lubricating oil to pony rod 27 as it reciprocates back and forth through support bushing 31. As shown in FIG. 15A, with the pump module labelled as 24*a* and piston 40 slidably disposed in pump chamber 42, lubricating oil can be pumped by an oil pump (not shown) into oil inlet 108 where it can flow into annulus 110 between pony rod 27 and support bushing 31 thereby maintaining a layer of lubricating oil therebetween. Oil can then flow out of annulus 110 into galleys 38 (as shown in FIG. 2) where the oil can be collected and re-circulated. In some embodiments, barrier seals 99 and ice-breaker wear band 100 can be disposed between pony rod 27 and support bushing 31 as sealing means to separate and isolate chamber 106 from annulus 110 so that coolant does not intermingle with and contaminate the lubricating oil, and vice-versa.

Figure 15B:
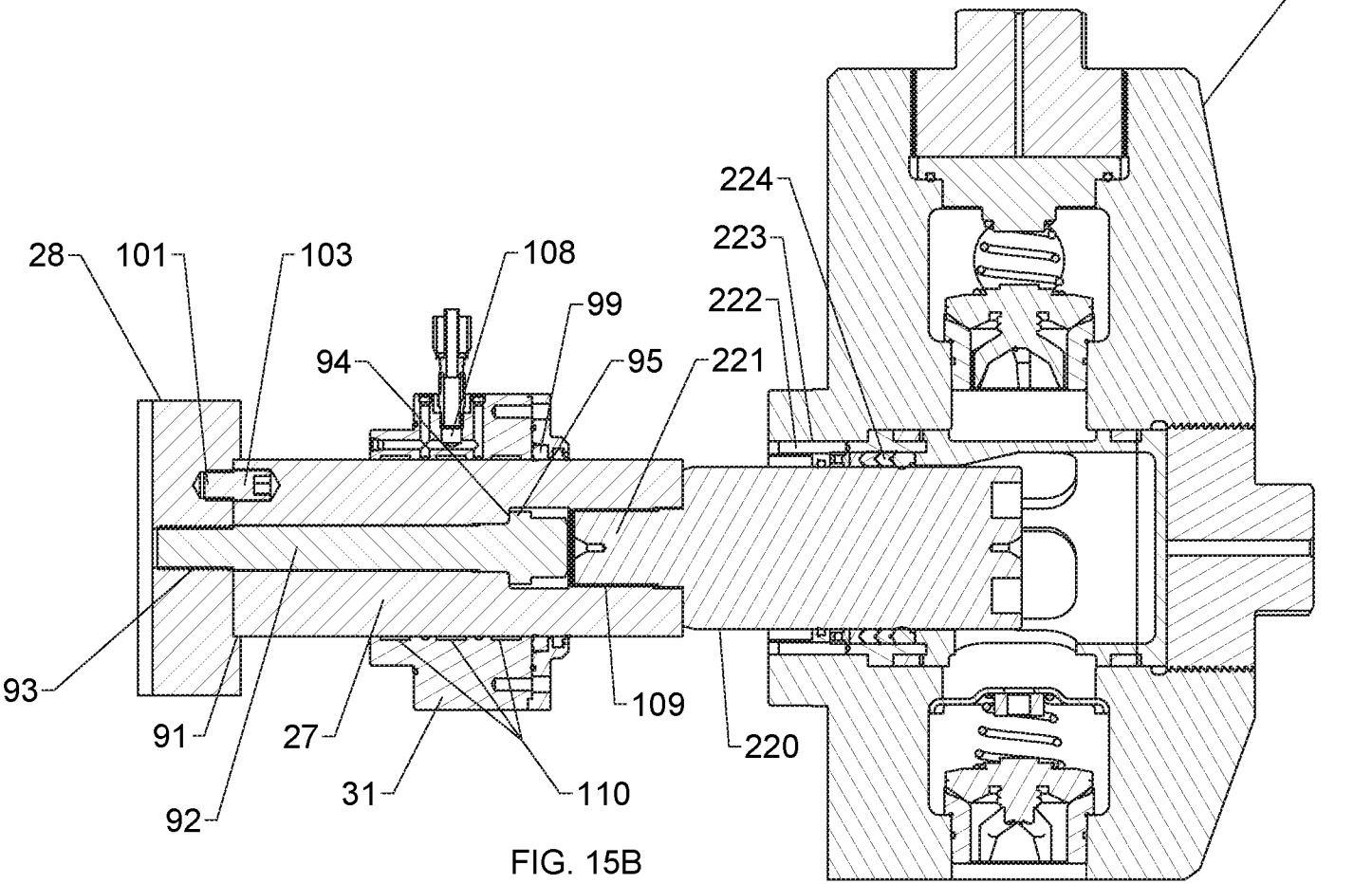
FIG. 15B is a front cross-section view depicting one pony rod assembly of a mud pump comprising a plunger-style pump fluid end module.

Referring to FIG. 15B, a cross-section view is shown of a plunger embodiment of the internal pumping mechanism of mud pump 10. In some embodiments, pony rod 27 can be coupled to slide 28 by placing pony rod 27 into opening 91 disposed on slide 28. In some embodiments, pony rod 27 can be further secured with pin 101 disposed on slide 28, wherein pin 101 is configured to fit within opening 103 disposed in pony rod 27 to prevent rotation thereof in opening 91. In some embodiments, pony rod stud 92 can be disposed in an opening disposed through pony rod 27 and secured to slide 28 in threaded opening 93. In some embodiments, pony rod stud 92 can further comprise flange 95 that can rest against shoulder 94 disposed within pony rod 27. In some embodiments, threaded stud 221 of plunger 220 can be threaded into threaded opening 109 of pony rod 27. In this embodiment, pump module 24*b* can comprise stuffing box 222 disposed in opening 223 of pump module 24*b*. Stuffing box 222 can further comprise one or more circumferential seals 224 disposed therein to seal around plunger 220 as it reciprocates in and out of stuffing box 222.

Figure 16:
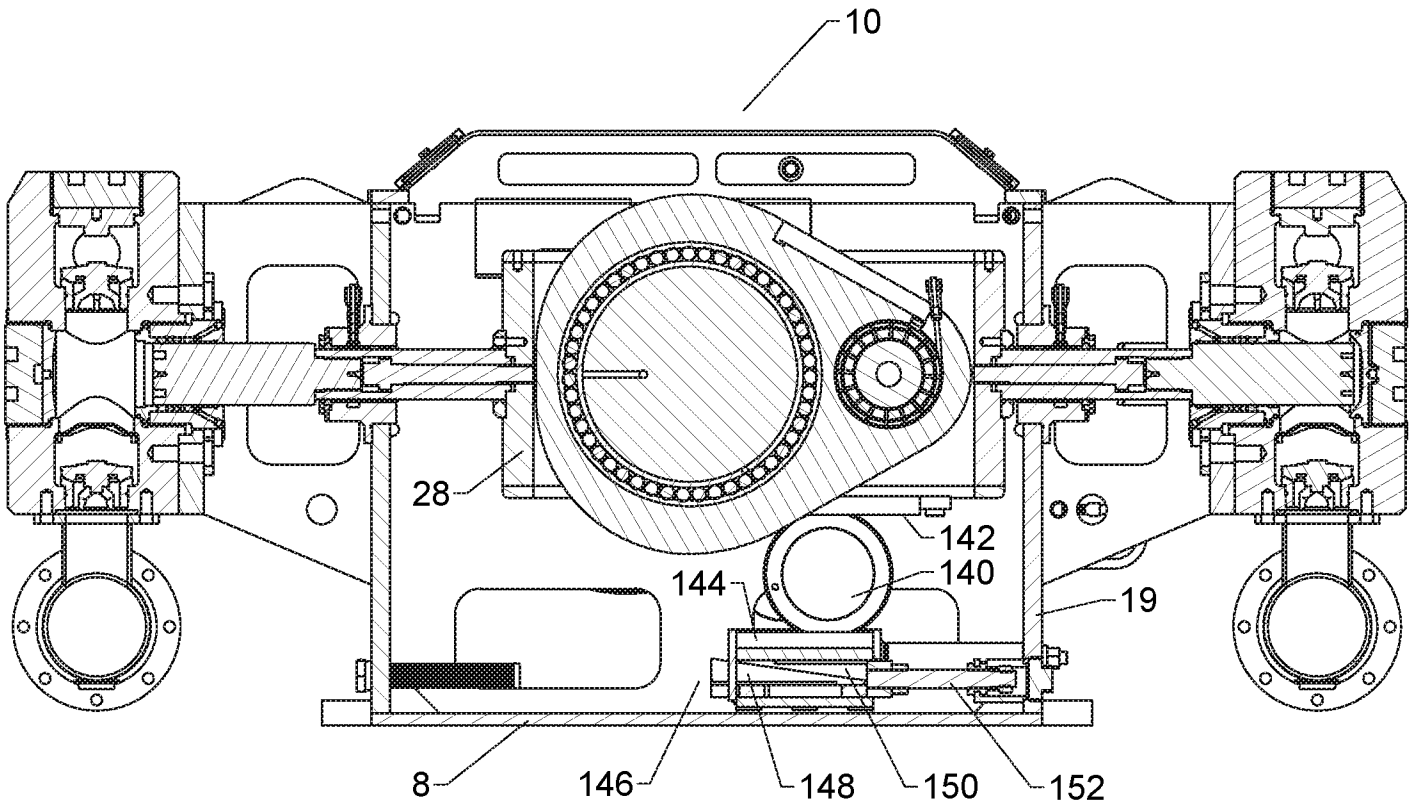
FIG. 16 is a front cross-section view depicting a second embodiment of the mud pump of FIG. 4.

Referring to FIG. 16, an alternate embodiment of the support mechanism for use with improved mud pump 10 is shown. In this embodiment, the support mechanism can comprise of support wheel 140 configured to disposed and roll between upper track 142, disposed on a lower surface of slide 28, and lower track 144, disposed on adjuster mechanism 146 that is further disposed on bottom plate 8. Wheel 140 can comprise of a similar construction as wheel 120, comprising a plurality of anti-skidding balls, as described herein, disposed around the circumference of wheel 140 and corresponding pockets disposed along upper track 142 and lower track 144. Alternatively, each upper track 142 and lower track 144 can comprise anti-skidding balls disposed therealong with corresponding pockets disposed around the circumference of wheel 140. To adjust the lash or clearance between wheel 140 and slide 28, adjuster mechanism 146 can raise or lower wheel 140 in relation to slide 28 to minimize the clearance therebetween and to center pony rods 27 in support bushings 31. In some embodiments, adjuster mechanism 146 can comprise of wedge 148 and overlapping wedge 150, wedge 148 operatively coupled to adjusting bolt 152, wherein lower track 144 can be disposed on top of wedge 150. By turning adjusting bolt 152 clockwise, as an example, wedge 148 can move towards to right thereby lifting wedge 150 to raise lower track 144 and, thus, wheel 140 towards upper track 142 to decrease the lash or clearance therebetween. By turning adjusting bolt 152 counter-clockwise, as an example, wedge 148 can move to the left thereby lowering wedge 150 to lower track 144 and, thus, wheel 140 away from upper track 142 to increase the lash or clearance therebetween.

Figure 17:
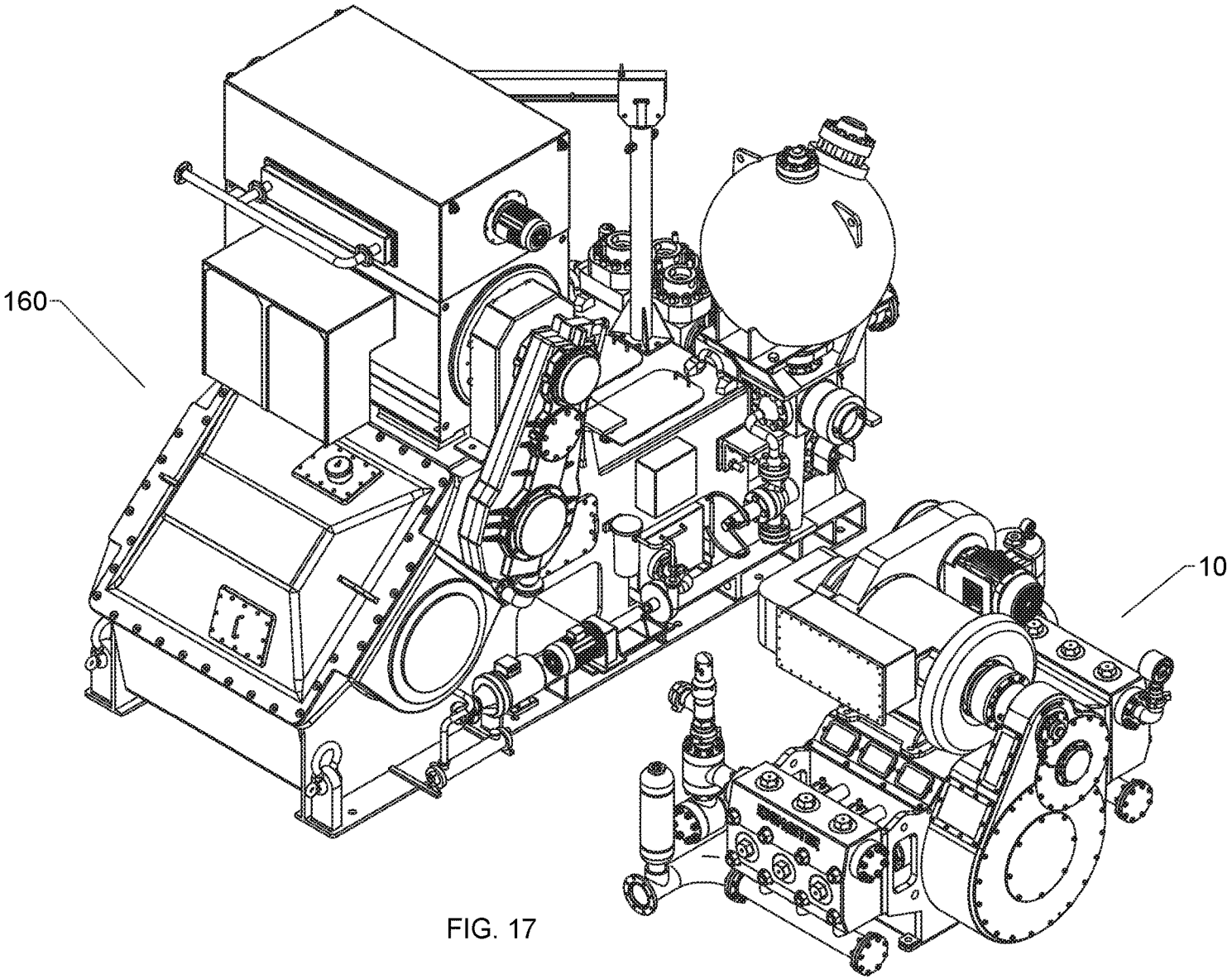
FIG. 17 is a perspective view depicting the mud pump of FIG. 2 situated beside a prior art mud pump.

Referring to FIG. 17, improved mud pump 10 is shown beside an example of prior art mud pump 160 having a similar pumping capacity to mud pump 10. It is apparent from this comparison that at least one advantage of improved mud pump 10 is a reduction of size of an equivalent performing mud pump, which can translate into a reduction of cost to an operator in terms of upfront material costs to manufacture the mud pump, a reduction of the cost to maintain the mud pump, a reduction of cost in moving the improved mud pump from site to site, a reduction of costs related to the operation of the mud pump and, at least, a reduction of space required at a site when the improved mud pump is positioned for pumping mud.

Figure 20:
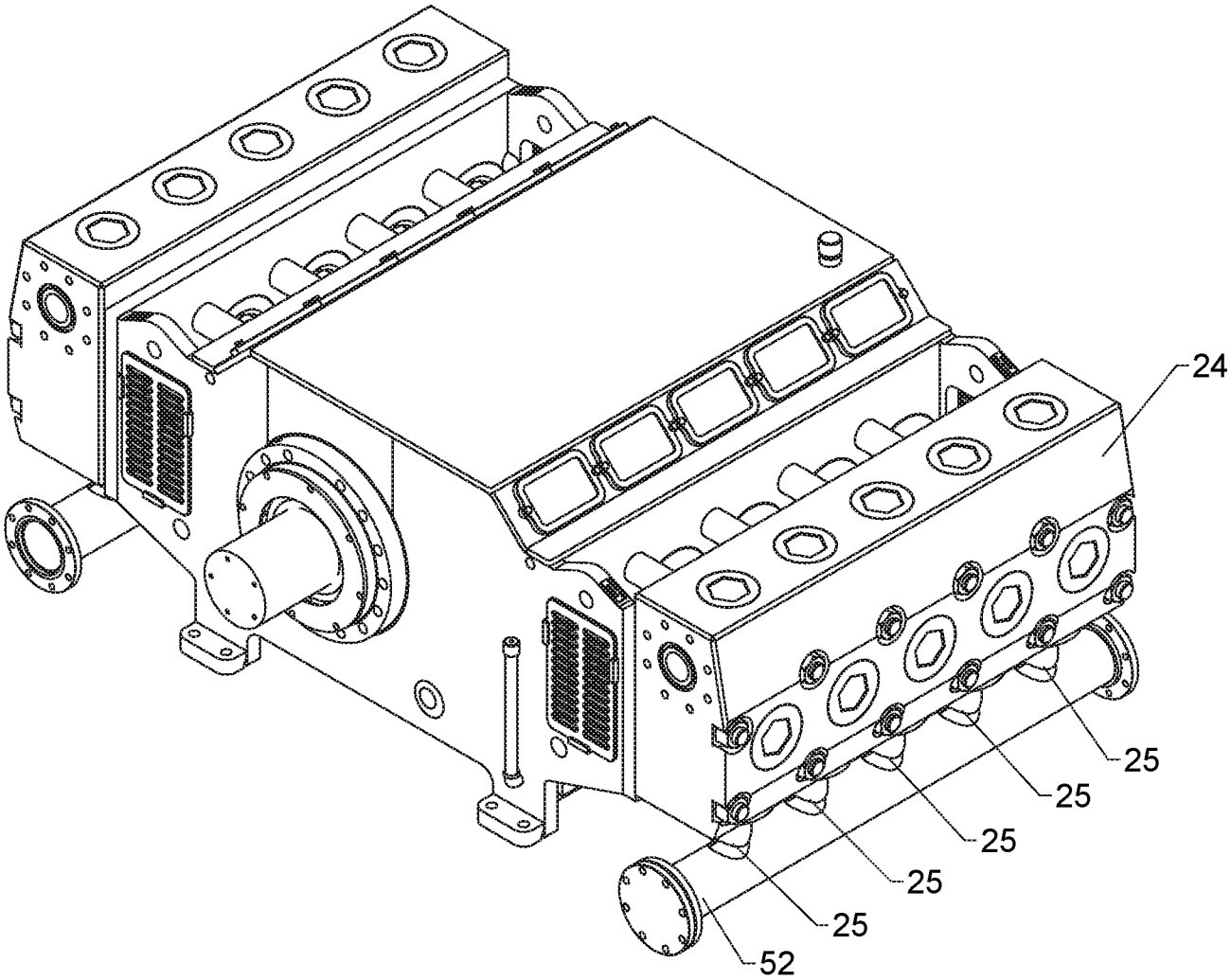
FIG. 20 is a perspective view depicting an embodiment of the mud pump of FIG. 2 having 10 pump fluid end modules.

In the embodiments illustrated the figures herein, there are three slides 28 shown, each coupled to two opposing pump fluid end modules 24 thereby resulting in the operation of six pump fluid end modules. It is obvious to those skilled in the art that fewer or more slides mechanisms can be implemented to either decrease or increase the number of pump fluid end modules that can be operated. As an example, and as shown in FIG. 20, mud pump 10 can comprise 5 pump fluid end modules 24 a side, or ten in total. It is also obvious to those skilled in the art that a slide frame can be releasably coupled to a single pony rod to, therefore, operate a single pump fluid end module.

Referring to FIG. 2, mud pump 10 is shown in a triplex configuration, wherein each side of mud pump 10 operates three pump fluid end modules 24 thus requiring pump shaft 30 to rotate three connecting rods 84. This necessarily requires pump shaft 30 having three eccentric lobes 80. In this configuration, the lobes can be displaced nominally 120° apart from each other such that the lobes can be substantially spaced equally apart around the circumference of pump shaft 30. In embodiments where pump shaft 30 comprises two eccentric lobes 80, the lobes can be displaced nominally 180° apart. In other embodiments where pump shaft 30 comprises two lobes 80, one lobe 80 can be displaced 178° from the other lobe 80 so that pump shaft 30 can more easily turn from a dead stop. In other embodiments where additional eccentric lobes are disposed on pump shaft 30, the lobes can be substantially spaced equally apart on pump shaft 30. For example, for a four-lobe shaft, each lobe 80 can be displaced 90° nominally from each other lobe 80. If five lobes are disposed on pump shaft 30, the lobes can be displaced nominally 72° apart on pump shaft 30, as would be the case for the embodiment of mud pump 10 shown in FIG. 20. For six lobes disposed on pump shaft 30, the lobes can be displaced nominally 60° apart, and so on as well known to those skilled in the art.

In operation, mud can be supplied to inlet 54 on intake manifold 52 from an external pump (not shown) drawing mud from a mud tank (not shown) as well known to those skilled in the art. As slides 28 operate pump fluid end modules 24, mud is drawn into pump fluid end modules 24 from intake manifold 52 and pumped out of pump fluid end modules 24 into outlet manifold 58 via outlet manifold couplers 62 disposed between pump fluid end modules 24 and outlet manifold 58. The pumped mud can exit outlet manifold 58 via outlet 60 that can be connected to a mud delivery pipe and/or hose for use on a drilling rig (not shown) as well known to those skilled in the art. In one embodiment, the diameter of inlet 54 and the pipe that make up intake manifold 52 can be nominally ten inches whereas the diameter of outlet and the pipe that make up outlet manifold 58 can be nominally four inches. In another embodiment, outlet manifold 58 can comprise couplings (as shown in FIG. 4) for connection with pressure gauge 33 to provide a visual indication of the pressure of the mud being pumped and/or a pressure relief valve to provide means to limit the pressure of the mud being pumped by mud pump 10. It is obvious to those skilled in the art that the diameters of inlet 54, intake manifold 52, outlet manifold 58 or outlet 60 can be increased or decreased depending on the volume and pressure of drilling mud required in the drilling of a well.

In operation, it is expected that mud pump 10 can operate up to 200 revolutions, which translates up to 400 pump fluid end module strokes per minute per slide frame mechanism given that each slide frame can be coupled to two pump fluid end modules. Given an input power up to 3000 horsepower, it is anticipated that mud pump 10 can pump up to 750 gallons or 3.75 cubic meters of drilling mud per minute at up to 7500 pounds per square inch of pressure. It is also expected that mud pump 10 would weigh approximately 45,000 pounds including the motor and all other related equipment required to pump drilling mud at the equivalent volume and pressure of drilling mud as a conventional mud pump powered by the same motor but weighing up to 120,000 pounds.

Figure 18:
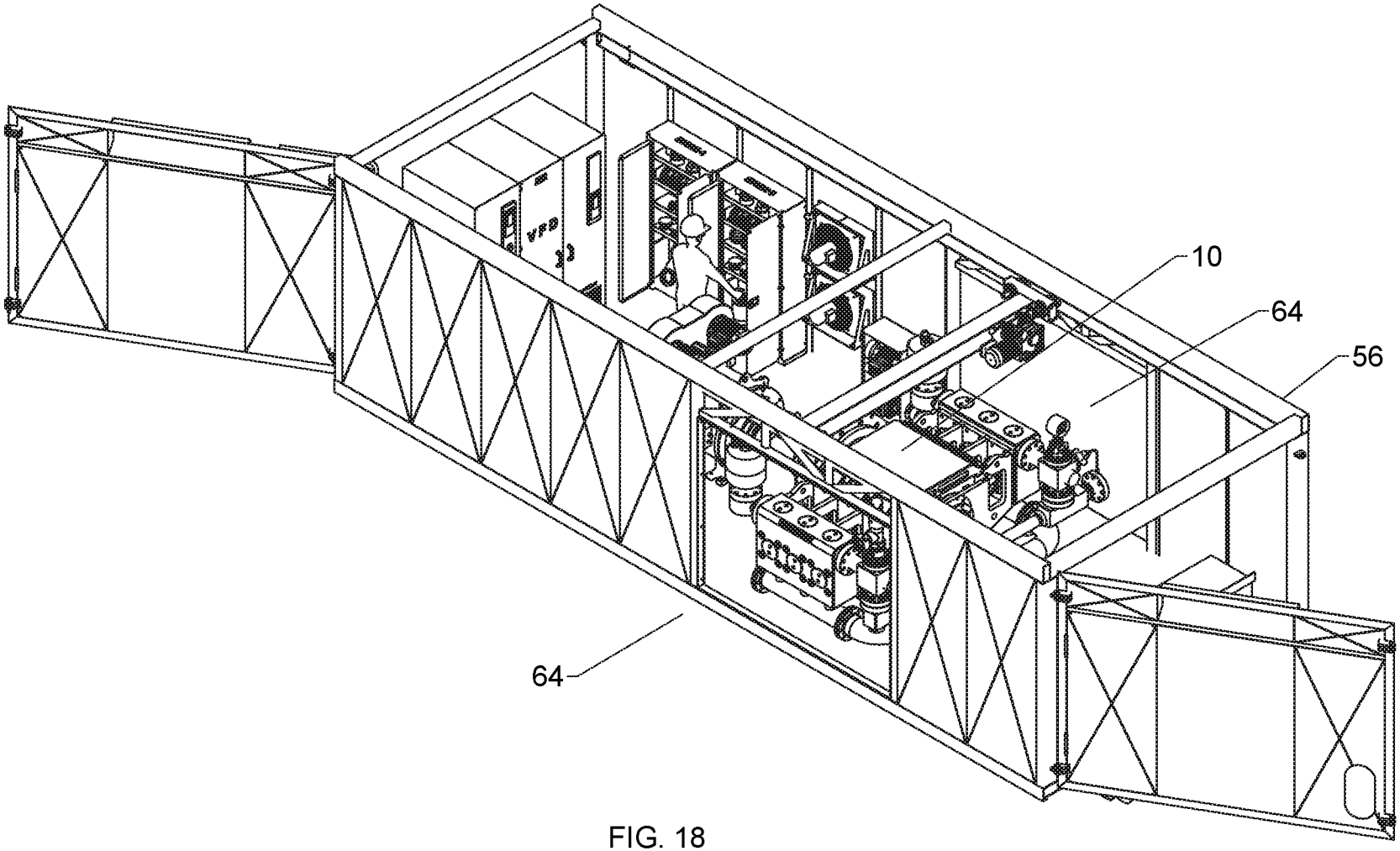
FIG. 18 is a perspective view depicting the mud pump of FIG. 2 longitudinally installed in a pump house.

Referring to FIG. 18, mud pump 10 is shown positioned in pump house 56, a structure used to house mud pumps at drilling sites. Access to mud pump 10 is done through doorways 64. In this configuration, mud pump 10 can be positioned "lengthwise" in pump house 56.

Figure 19:
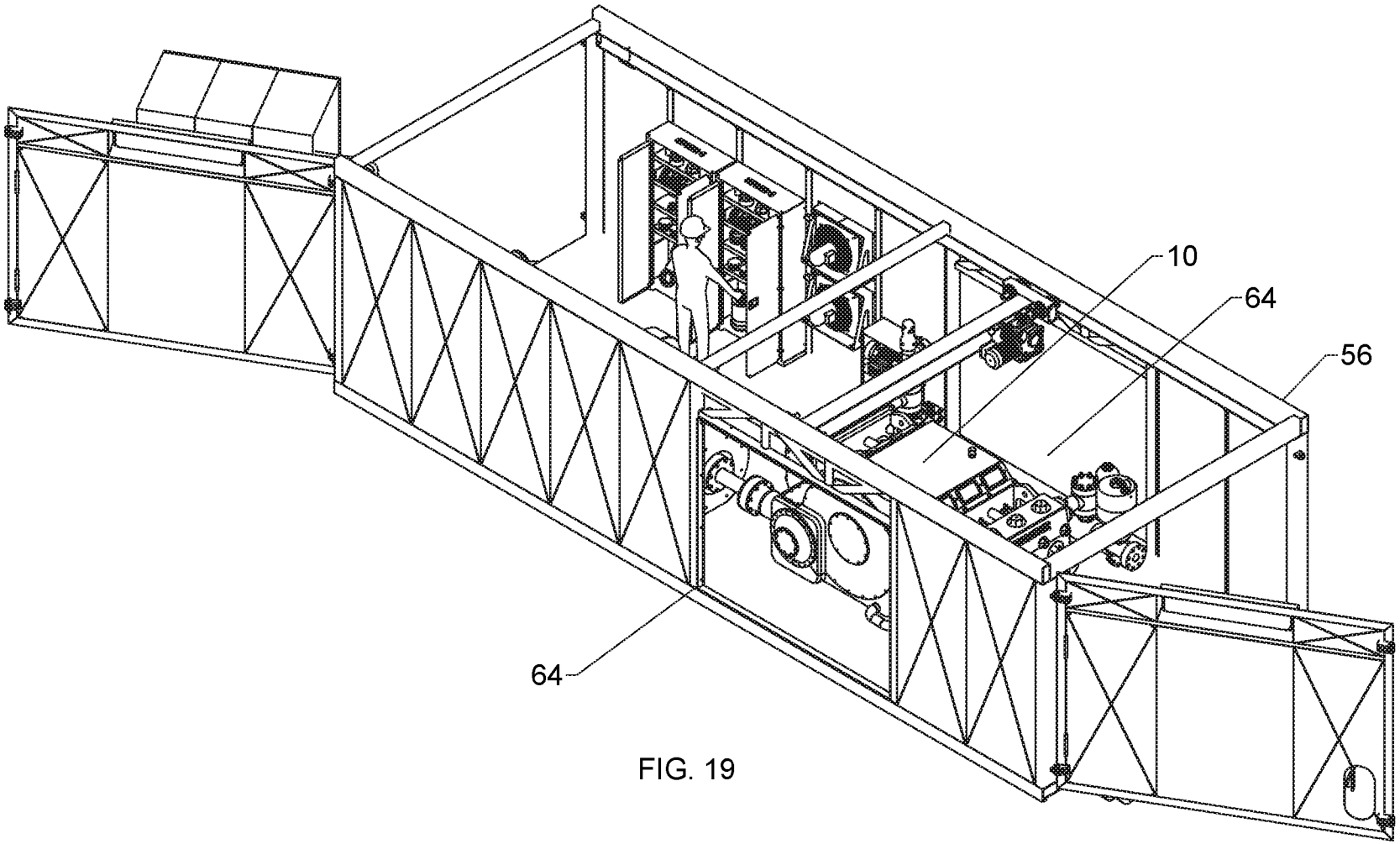
FIG. 19 is a perspective view depicting the mud pump of FIG. 2 transversally installed in a pump house.

Referring to FIG. 19, mud pump 10 is shown in pump house 56 rotated 90 degrees as compared to the embodiment shown in FIG. 18. The compactness of mud pump 10 can allow it to be installed in this manner in pump house 56 whereby access to the inlet and outlet to mud pump 10 is through doorway 64. In addition, more than one mud pump 10 can be installed in pump house 56 thereby reducing the number of pump houses required at a drilling site if the well being drilled requires a volume of pressurized drilling mud greater than what one mud pump 10 can provide.

Figure 21:
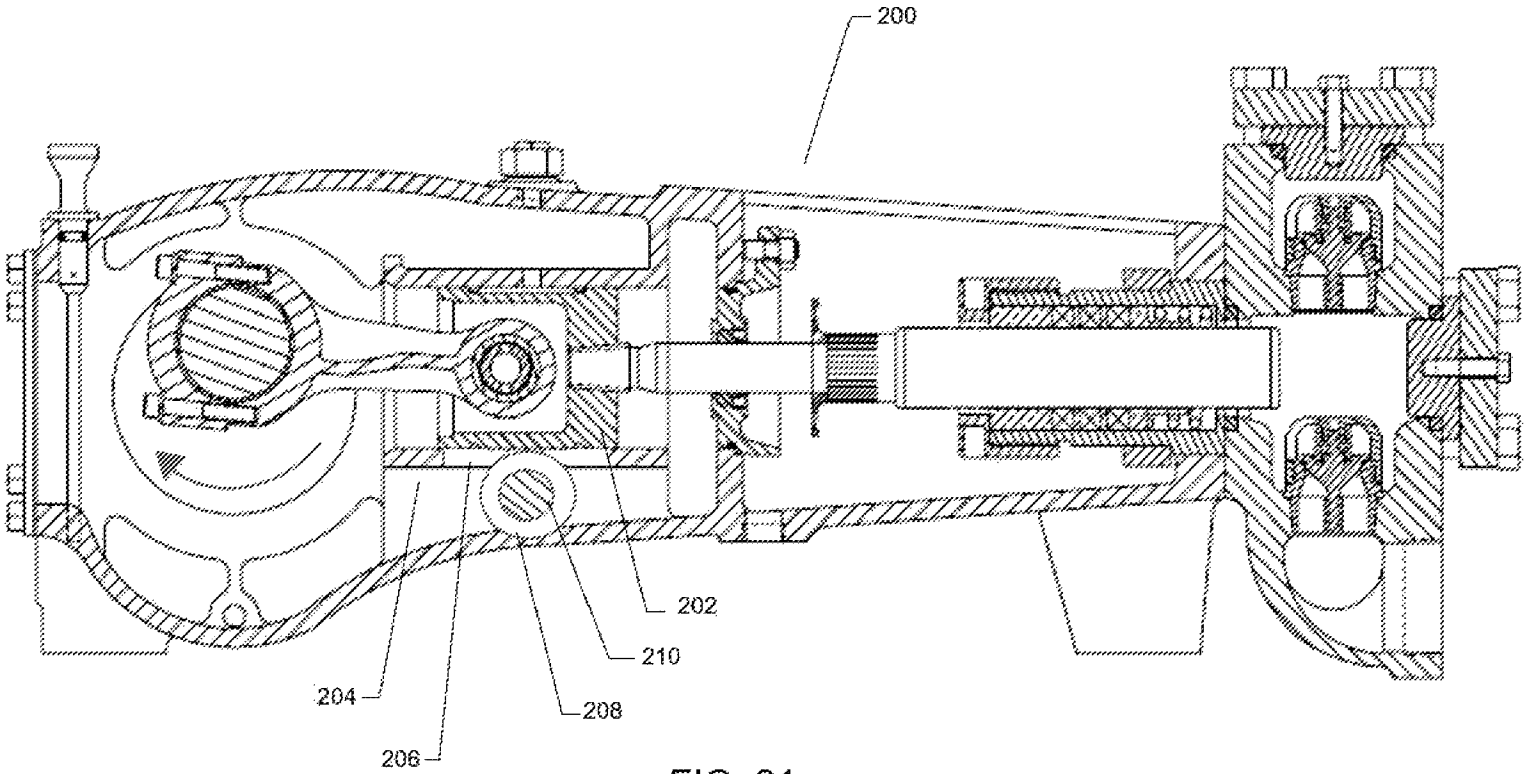
FIG. 21 is a side cross-section view depicting an improved prior art mud pump comprising a support wheel.

Referring to FIG. 21, another embodiment of a support wheel mechanism can be provided for retro-fitting a conventional mud pump, represented by reference character 200. In some embodiments, support wheel 208 can be rotatably disposed on axle 210, further disposed within the body of prior art mud pump 200, wherein opening 206 is made in liner 204 so as to enable crosshead 202 to roll along wheel 208 similar to how slide 28 can roll along wheel 120 or wheel 140 in the embodiments described above. In some embodiments, wheel 140 can comprise the anti-skidding balls disposed therein, which can be configured to fit within pockets along crosshead 202. Alternatively, a plurality of anti-skidding balls can disposed along cross crosshead 202 with corresponding pockets disposed around the circumference of wheel 208.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A mud pump, comprising:

a) a frame;

b) at least one pump fluid end module disposed on the frame, the at least one pump fluid end module comprising an inlet port and an outlet port;

c) a pump shaft rotatably disposed in the frame for receiving rotational power from a motor, the pump shaft having at least one substantially circular eccentric lobe disposed thereon, a center of the at least one substantially circular eccentric lobe displaced or offset from a longitudinal axis of the pump shaft;

d) at least one slide disposed in the frame, the at least one slide operatively configured to move linearly side-to-side within the frame, the at least one slide further comprising a pair of substantially parallel spaced-apart sidewalls;

e) at least one pony rod assembly operatively coupling the at least one slide to the at least one pump fluid end module;

f) a connecting rod comprising first and second ends operatively coupling the pump shaft to the at least one slide, the connecting rod disposed between the pair of substantially parallel spaced-apart sidewalls of the at least one slide such that the connecting rod is pivotable relative to the pair of substantially parallel spaced-apart sidewalls of the at least one slide, the first end of the connecting rod rotatably disposed on the at least one substantially circular eccentric lobe, the second end of the connecting rod rotatably pinned to the pair of substantially parallel spaced-apart sidewalls of the at least one slide whereby rotation of the pump shaft causes the at least one slide to move linearly side-to-side that, in turn, causes the at least one pony rod assembly to operate the at least one pump fluid end module; and g) a support mechanism disposed beneath and operatively coupled to the at least one slide.

2. The mud pump as set forth in claim 1, further comprising an outlet manifold operatively coupled to the outlet port of the at least one pump fluid end module, the outlet manifold providing communication between the outlet port of the at least one pump fluid end module and an outlet manifold outlet.

3. The mud pump as set forth in claim 1, wherein the pony rod assembly further comprises:

a) a pony rod support bushing configured to be disposed on the frame;

b) a stuffing box disposed in the at least one pump fluid end module; and c) a pony rod slidably disposed in the pony rod support bushing, the pony rod comprising first and second ends, the first end of the pony rod operatively coupled to the at least one slide, the second end of the pony rod further comprising a plunger slidably disposed in the stuffing box.

4. The mud pump as set forth in claim 1, further comprising a pump house wherein the mud pump is disposed in the pump house.

5. The mud pump as set forth in claim 1, further comprising a transmission operatively disposed between the motor and the pump shaft thereby coupling the motor to the pump shaft.

6. The mud pump as set forth in claim 5, wherein the transmission further comprises a single-stage or a multi-stage transmission.

7. The mud pump as set forth in claim 1, wherein the motor comprises a 3-phase alternating current electric motor.

8. The mud pump as set forth in claim 7, further comprising an intake manifold operatively coupled to the inlet port of the at least one pump fluid end module, the intake manifold providing communication between an intake manifold inlet and the inlet port of the at least one pump fluid end module.

9. The mud pump as set forth in claim 1, wherein the at least one pony rod assembly further comprises:

a) a pony rod support bushing configured to be disposed on the frame;

b) a piston liner comprising first and second ends, the second end of the piston liner operatively coupled to the at least one pump fluid end module; and c) a pony rod slidably disposed in the pony rod support bushing, the pony rod comprising first and second ends, the first end of the pony rod operatively coupled to the at least one slide, the second end of the pony rod further comprising a piston slidably disposed in the piston liner thereby forming a liner chamber disposed between the piston and the pony rod support bushing.

10. The mud pump as set forth in claim 9, wherein the pony rod support bushing further comprises means for circulating coolant and lubricant through the liner chamber.

11. The mud pump as set forth in claim 9, wherein the pony rod support bushing further comprises means for lubricating the pony rod.

12. The mud pump as set forth in claim 1, wherein the support mechanism comprises a support wheel rotatably disposed beneath the at least one slide, the at least one slide configured to roll along on top of the support wheel.

13. The mud pump as set forth in claim 12, wherein the support wheel comprises an anti-skidding engagement mechanism.

14. The mud pump as set forth in claim 13, wherein the anti-skidding engagement mechanism comprises a plurality of anti-skidding balls disposed on one of the support wheel and the at least one slide, and a plurality of corresponding pockets disposed on the other of the support wheel and the at least one slide.

15. The mud pump as set forth in claim 14, wherein the support wheel is rotatably disposed on an axle operatively coupled to the frame.

16. The mud pump as set forth in claim 15, wherein the plurality of anti-skidding balls are disposed around a circumference of the support wheel and the plurality of corresponding pockets are disposed along a lower edge of the at least one slide.

17. The mud pump as set forth in claim 14, wherein the support wheel is rotatably disposed on an adjuster mechanism, the adjuster mechanism comprising a fixed wedge and an overlapping moving wedge, a combination of which raises or lowers the support wheel relative to the at least one slide.

18. The mud pump as set forth in claim 17, wherein the plurality of anti-skidding balls are disposed along a lower edge of the at least one slide and the plurality of corresponding pockets are disposed around a circumference of the support wheel.

19. A mud pump, comprising:

a) a platform;

b) a lattice frame disposed on the platform;

c) at least one pump fluid end module disposed on the lattice frame, the at least one pump fluid end module comprising an inlet port and an outlet port;

d) a pump shaft rotatably disposed in the lattice frame for receiving rotational power, the pump shaft having at least one substantially circular eccentric lobe disposed thereon, a center of the at least one substantially circular eccentric lobe displaced or offset from a longitudinal axis of the pump shaft;

e) a motor operatively coupled to the pump shaft, the motor disposed on the platform;

f) at least one slide disposed in the lattice frame, the at least one slide operatively configured to move linearly side-to-side within the lattice frame, the at least one slide further comprising a pair of substantially parallel spaced-apart sidewalls;

g) at least one pony rod assembly operatively coupling the at least one slide to the at least one pump fluid end module;

h) a connecting rod comprising first and second ends operatively coupling the pump shaft to the at least one slide, the connecting rod disposed between the pair of substantially parallel spaced-apart sidewalls of the at least one slide such that the connecting rod is pivotable relative to the pair of substantially parallel spaced-apart sidewalls of the at least one slide sidewalls, the first end of the connecting rod rotatably disposed on the at least one substantially circular eccentric lobe, the second end of the connecting rod rotatably pinned to the pair of substantially parallel spaced-apart sidewalls of the at least one slide whereby rotation of the pump shaft causes the at least one slide to move linearly side-to-side that, in turn, causes the at least one pony rod assembly to operate the at least one pump fluid end module; and i) a support mechanism disposed beneath and operatively coupled to the at least one slide.

20. The mud pump as set forth in claim 19, wherein the motor comprises a 3-phase alternating current electric motor.

21. The mud pump as set forth in claim 19, further comprising an intake manifold operatively coupled to the inlet port of the at least one pump fluid end module, the intake manifold providing communication between an intake manifold inlet and the inlet port of the at least one pump fluid end module.

22. The mud pump as set forth in claim 19, further comprising an outlet manifold operatively coupled to the outlet port of the at least one pump fluid end module, the outlet manifold providing communication between the outlet port of the at least one pump fluid end module and an outlet manifold outlet.

23. The mud pump as set forth in claim 19, wherein the pony rod assembly further comprises:

a) a pony rod support bushing configured to be disposed on the lattice frame;

b) a stuffing box disposed in the at least one pump fluid end module; and c) a pony rod slidably disposed in the pony rod support bushing, the pony rod comprising first and second ends, the first end of the pony rod operatively coupled to the at least one slide, the second end of the pony rod further comprising a plunger slidably disposed in the stuffing box.

24. The mud pump as set forth in claim 19, further comprising a pump house wherein the mud pump is disposed in the pump house.

25. The mud pump as set forth in claim 19, further comprising a transmission operatively disposed between the motor and the pump shaft thereby coupling the motor to the pump shaft.

26. The mud pump as set forth in claim 25, wherein the transmission further comprises a single-stage or a multi-stage transmission.

27. The mud pump as set forth in claim 19, wherein the at least one pony rod assembly further comprises:

a) a pony rod support bushing configured to be disposed on the lattice frame;

b) a piston liner comprising first and second ends, the second end of the piston liner operatively coupled to the at least one pump fluid end module; and c) a pony rod slidably disposed in the pony rod support bushing, the pony rod comprising first and second ends, the first end of the pony rod operatively coupled to the at least one slide, the second end of the pony rod further comprising a piston slidably disposed in the piston liner thereby forming a liner chamber disposed between the piston and the pony rod support bushing.

28. The mud pump as set forth in claim 27, wherein the pony rod support bushing further comprises means for circulating coolant and lubricant through the liner chamber.

29. The mud pump as set forth in claim 27, wherein the pony rod support bushing further comprises means for lubricating the pony rod.

30. The mud pump as set forth in claim 19, wherein the support mechanism comprises a support wheel rotatably disposed beneath the at least one slide, the at least one slide configured to roll along on top of the support wheel.

31. The mud pump as set forth in claim 30, wherein the support wheel comprises an anti-skidding engagement mechanism.

32. The mud pump as set forth in claim 31, wherein the anti-skidding engagement mechanism comprises a plurality of anti-skidding balls disposed on one of the support wheel and the at least one slide, and a plurality of corresponding pockets disposed on the other of the support wheel and the at least one slide.

33. The mud pump as set forth in claim 32, wherein the support wheel is rotatably disposed on an axle operatively coupled to the lattice frame.

34. The mud pump as set forth in claim 33, wherein the plurality of anti-skidding balls are disposed around a circumference of the support wheel and the plurality of corresponding pockets are disposed along a lower edge of the at least one slide.

35. The mud pump as set forth in claim 32, wherein the support wheel is rotatably disposed on an adjuster mechanism, the adjuster mechanism comprising a fixed wedge and an overlapping moving wedge, a combination of which can raise or lower the support wheel relative to the at least one slide.

36. The mud pump as set forth in claim 35, wherein the plurality of anti-skidding balls are disposed along a lower edge of the at least one slide and the plurality of corresponding pockets are disposed around a circumference of the support wheel.

* * * * *